US007284486B2

(12) United States Patent
Winter et al.

(10) Patent No.: US 7,284,486 B2
(45) Date of Patent: Oct. 23, 2007

(54) DEVICE AND METHOD FOR CONTROLLING THE POSITION OF THE LATERAL EDGE OF A CONTINUOUS WEB

(75) Inventors: Hans Winter, München (DE); Günter Gassner, Mühldorf (DE)

(73) Assignee: Oce Printing Systems GmbH, Poing (DE)

( * ) Notice: Subject to any disclaimer, the term of this patent is extended or adjusted under 35 U.S.C. 154(b) by 401 days.

(21) Appl. No.: 11/079,732

(22) Filed: Mar. 14, 2005

(65) Prior Publication Data

US 2005/0158106 A1 Jul. 21, 2005

Related U.S. Application Data

(63) Continuation of application No. 10/685,227, filed on Oct. 14, 2003, now abandoned.

(30) Foreign Application Priority Data

Oct. 11, 2002 (DE) ..... 102 47 455

(51) Int. Cl.
*B41F 21/12* (2006.01)

(52) U.S. Cl. ..... 101/485; 101/484; 101/171; 101/181

(58) Field of Classification Search ..... 101/483–485, 101/171, 181
See application file for complete search history.

(56) References Cited

U.S. PATENT DOCUMENTS

| | | | |
|---|---|---|---|
| 4,896,807 | A | 1/1990 | Mundschau |
| 5,021,673 | A | 6/1991 | Dragon et al. |
| 6,104,907 | A | 8/2000 | Obata et al. |
| 6,305,856 | B1 | 10/2001 | Miyazaki |
| 6,450,381 | B1 | 9/2002 | Ernst et al. |

FOREIGN PATENT DOCUMENTS

| | | |
|---|---|---|
| DE | 197 00 396 A1 | 7/1997 |
| EP | 0 608 124 A2 | 7/1994 |

*Primary Examiner*—Minh Chau
(74) *Attorney, Agent, or Firm*—Schiff Hardin LLP

(57) ABSTRACT

A device and a method for controlling a position of a lateral edge of a continuous web of a recording medium in a printer or copier provides that sensors are provided. Signals of the sensors are supplied to a control device which includes an actuator. The actuator changes the position of the lateral edge of the web.

38 Claims, 21 Drawing Sheets

DEVICE AND METHOD FOR CONTROLLING THE POSITION OF THE LATERAL EDGE OF A CONTINUOUS WEB

CROSS-REFERENCE TO RELATED APPLICATION

The present application is a Continuation of patent application Ser. No. 10/685,227, filed Oct. 14, 2003, now abandoned.

BACKGROUND OF THE INVENTION

1. Field of the Invention

The present invention relates generally to a device and a method for controlling the position of the lateral edge of a continuous web of a recording medium in a printer or copier.

2. Description of the Related Art

In many printers or copiers, a continuous web such as a paper web is used as a recording medium, this web either being provided with a marginal perforation or not. If marginal perforations are provided, then the guidance of this web through the printer or copier is relatively easy since the lateral edge of the web is clearly defined by the engagement of pin-feed wheels in the marginal perforation. If the web has no marginal perforation, then a lateral displacement of the lateral edge can occur during the transport of the web through the copier or printer owing to inhomogeneities in the web, and the print image cannot be printed in a positionally accurate way.

In order to achieve a positionally accurate guidance, a web retracting device is provided in the entrance region of the printer or copier, the web retracting device exerting a restraining force on the web. As viewed in a transport direction of the web during the normal printing operation, an actuator in the form of a rotary frame is provided downstream thereof, which adjusts the position of the lateral edge of the web by rotation. Following the actuator, a web drive is provided which advances the web in the transport direction against the restraining force of the retracting device. Subsequently, the web is supplied to at least one transfer printing station in which toner images are printed on the web. Following the transfer printing station, a take-off device is arranged, which further conveys the web for further processing, e.g. for fixing the toner images.

During the transport of the web through the printer or copier, the lateral edge, as mentioned, can laterally drift away from the desired position. In order to position the print image in a positionally accurate way with respect to the lateral edge at the transfer printing station or at several transfer printing stations, the lateral edge of the web is controlled to a desired position with the aid of the rotary frame. For this purpose, a control device is used which processes signals of a sensor that senses the actual position of the lateral edge.

When guiding a paper web through a printer, lateral distortion of the paper web and a region-wise wave formation and/or single-edge sagging of the paper web can occur despite a stably running front edge of the web due to non-uniform mechanical web properties of the paper web or due to the basic setting of the various guide rollers not being exactly parallel. Such waves can be pressed into folds in the web at the web deflection locations in the transport apparatus, such as at counter-pressure rollers, for example, as required for transport of the web. Further, a single edge of the web may sag, for example, disturbing the image printing in the region of a non-contact fixing station since the sagging web section can come into contact with mechanical parts and the toner images are smeared as a result or the sagging section is subjected to an energy load that is too high.

U.S. Pat. No. 5,021,673 discloses a device for guiding a paper web in which rolls are provided at both lateral edges for guiding the web, the rolls exerting different pressure forces on the web. In this way, a lateral displacement of the web can be corrected.

U.S. Pat. No. 5,323,944 discloses a device for controlling the lateral position of a web, in which the web is guided through a pressure roller and a counter-pressure roller. The pressure roller is pivotable, and the force exerted on the counter-pressure roller along the axis can be varied in order to displace the lateral edge of the web. The current position of the lateral edge of the web is acquired with the aid of optoelectronic sensors.

U.S. Pat. No. 6,104,907 discloses a device for guiding a paper web in a printer. The paper web is guided and clamped around rollers in order to avoid vibrations and speed variations, as well as to counteract lateral displacement of the web. For example, for avoiding lateral displacement of the web, use is made of a guide roller having pins that engage into corresponding holes in the web. Another alternative provides to vary the force that a roller exerts along its axis on the paper web. In another alternative, the paper web is guided between pairs of upper and lower rollers. These upper and lower rollers contact and clamp the web with an increased angle of contact and thus avoid a speed variation of the web.

SUMMARY OF THE INVENTION

The present invention provides a device and a method for controlling the position of the lateral edge of a continuous web, which allow for a positionally accurate printing of print images onto the web with high quality.

This is achieved in a device for controlling the position of the lateral edge of a continuous web of a recording medium in a printer or copier, in which a web retracting device exerts a restraining force on the web, downstream of which web retracting device, as viewed in the transport direction of the web during normal printing operation, an actuator is provided which adjusts the position of the lateral edge of the web, downstream of which actuator a web drive is provided which advances the web in the transport direction against the restraining force of the retracting device, downstream of which web drive at least one transfer printing station is provided, which prints toner images on the web, and downstream of which transfer printing station a take-off device is provided, which further conveys the web for further processing, wherein a first sensor is provided in the region of the actuator, which sensor senses the actual position of the lateral edge of the web, wherein a control device compares the actual signal of the first sensor with a desired signal corresponding to a desired position of the lateral edge of the web and in case of a deviation drives the actuator which changes the position of the lateral edge.

According to the invention, a first sensor sensing the actual position of the lateral edge of the web is provided in the region of the actuator. A control device compares the actual signal of the first sensor with a desired signal corresponding to a desired position of the lateral edge of the web. In the case of a deviation, the actuator is driven such that the position of the lateral edge comes into correspondence with the desired position. Preferably, the desired position of the lateral edge of the web is fixed at the location of the first sensor.

What is achieved by the invention is that for every measured value of the first sensor and for a control deviation from a desired signal, a compensating motion is carried out by the actuator. Accordingly, one obtains a very quick settling of the position of the lateral edge to the desired position and a small control deviation from the desired position.

According to one embodiment of the invention the first sensor determines a plurality of measured values at predetermined distances along the web. An average of these measured values is then used as an actual signal for controlling the position of the lateral edge of the web. By means of this averaging, the entire closed loop control circuit is less susceptible to imperfections which occur along the lateral edge of the web, for example in the case of fraying of the lateral edge, bending and other irregularities. Only relatively long-wave deviations of an average of the position of the lateral edge result in a readjustment by the actuator.

According to a further embodiment of the invention, a second sensor is provided in the region of the retracting device, which second sensor senses the actual position of the lateral edge of the web in this region, this actual signal being taken into account when controlling the lateral edge to a desired position in the region of the first sensor. In this embodiment, thus, in addition the information about the position of the lateral edge in the paper feeding region is taken into account. If there is a deviation from a desired position in this region, then there is a high probability that this deviation is likewise present in the region of the actuator, i.e. of the rotary frame. If the control device is charged with the control deviation with respect to the second sensor, then this deviation can quickly be responded to and a quick adjustment of the actual position of the lateral edge to the desired position can take place.

A further important embodiment provides that a third sensor is provided in the region of the transfer printing station, which sensor acquires the actual position of the lateral edge of the web, the actual signal of the third sensor being taken into account by the control device when driving the actuator. With the aid of this third sensor it is possible to influence the actual position of the lateral edge in the region of the transfer printing location. In this way, a higher accuracy of the correspondence of the print image with the actual position of the lateral edge and thus an increased print quality are achieved.

According to a further aspect of the invention, a method and embodiments for this method are provided. The advantages that can be achieved with this method have already been described in connection with the device described further above.

BRIEF DESCRIPTION OF THE DRAWINGS

For a better understanding of the present invention, reference is made in the following to the preferred embodiments shown in the drawings, which embodiments are described on the basis of specific terminology. However, it is pointed out that the scope of the invention is not to be restricted thereby since such variations and further modifications to the devices shown and/or to the methods as well as such further applications of the invention as shown therein are considered as being common present or future knowledge of a relevant person skilled in the art.

DETAILED DESCRIPTION OF THE PREFERRED EMBODIMENTS

Figures 1A, 1B:
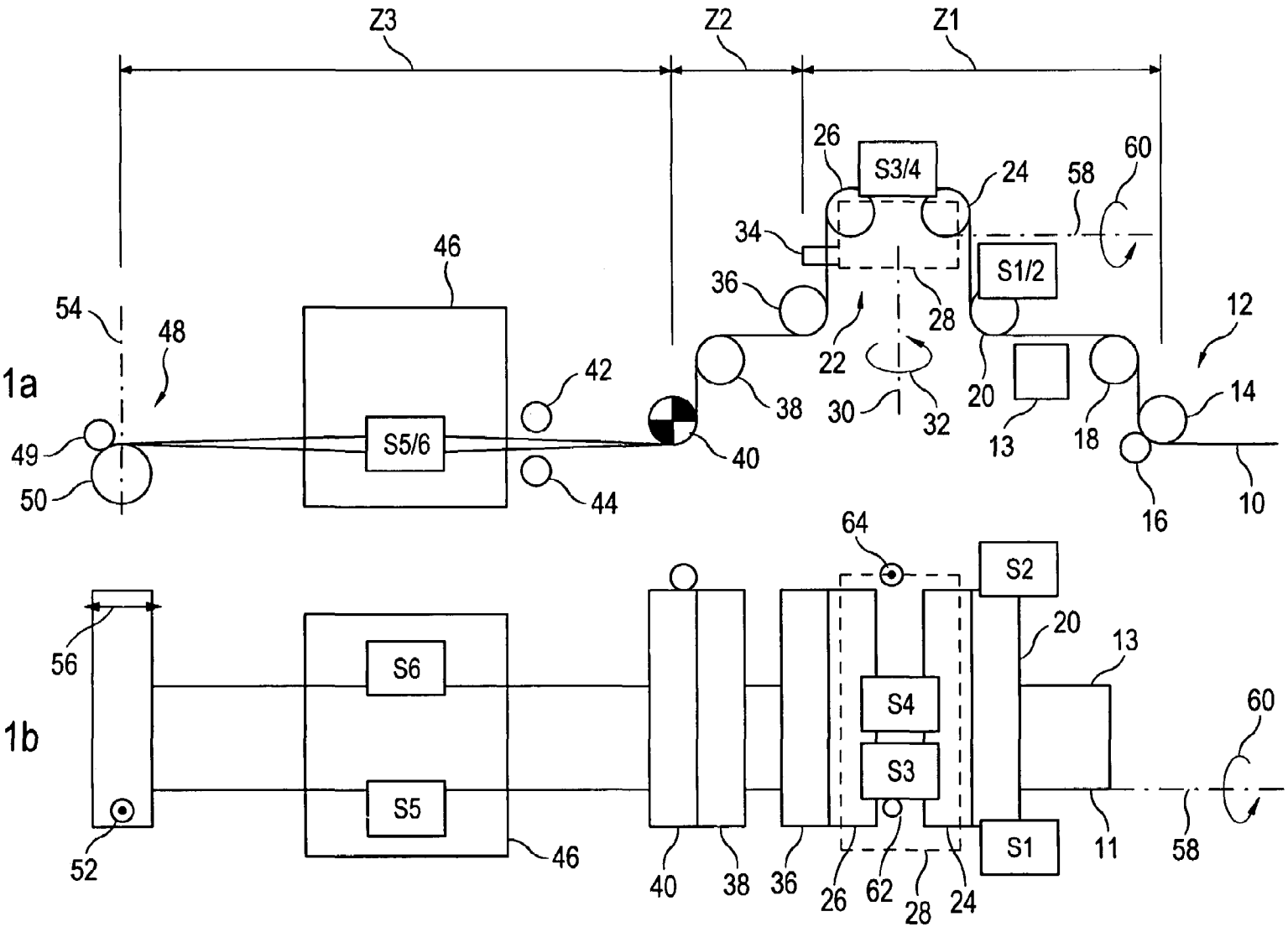
FIGS. 1*a* and 1*b* are a schematic illustrations of the paper transport in a high-performance printer having a rotary frame that is adjustable in two rotational axes as well as a pivotable take-off device according to the principles of the invention.

FIGS. 1*a* and 1*b* schematically show the transport of a continuous paper web 10 through a high-performance printer. FIG. 1*a* is a schematic side view, while FIG. 1*b* is a top view. The web transport through the printer takes place in three zones Z1, Z2 and Z3. In zone Z1, the paper web 10 is conveyed through a retracting device 12 comprising a roller 14 and a counter-pressure roller 16. The retracting device 12 serves to apply a predetermined web tension in a transport direction to the paper web 10. Subsequently, the paper web 10 is deflected at a deflection roller 18 and is supplied to a feed roller 20 which is located upstream a rotary frame 22 as viewed in the transport direction. The feed roller 20 comprises two sensors S1 and S2 for measuring the web tensile force as will be explained in more detail further below. The rotary frame 22 comprises two rollers 24 and 26, the axes of which are parallel and supported by a frame 28 illustrated in broken lines. The frame 28 is pivotable about a rotational axis 30 in the direction of the rotational arrow 32. The web transport is monitored by two sensors S3 and S4 which check the paper web 10 in the area between the rollers 24 and 26 from above. Alternatively, the paper web can likewise be checked by corresponding sensors from below.

In the exit region of the rotary frame 22, an edge sensor 34 is arranged so as to be fixed to the device and detects the actual position of the lateral edge of the paper web 10. Depending on the actual position and the deviation of the edge from a desired position, the rotary frame 22 is swiveled about the axis 30 on a support, and thus the lateral edge is adjusted to a predetermined desired position.

As viewed in the transport direction of the paper web 10, the rotary frame 22 is followed by a stabilizing roller 36 in the zone Z2, which stabilizing roller 36 serves to balance the web tension in the paper web 10. The stabilizing roller 36 can be slightly radially resilient or flexible and thus effects a passive balancing for the paper web 10. Further, in this zone Z2 a deflection roller 38 and a drive roller 40 are provided. The drive roller 40 exerts a tensile force on the paper web 10 and advances the paper web 10 against the resistance of a braking device 13, e.g. a vacuum brake. The drive roller 40 determines the speed at which the paper web 10 is advanced. Alternatively, the retracting device 12 can be used as a permanent brake.

In the zone Z3, a single-sided or two-sided printing of the paper web 10 takes place at the transfer printing rollers 42 and 44. Afterwards, the paper web 10 runs through a fixing station 46 in which the toner images applied to the paper web 10 are fixed, for example by means of an infrared fixing process. In the region of the fixing station 46, sensors S5 and S6 are provided which monitor the paper web 10. Towards the end of the zone Z3, a take-off device 48 comprising rollers 49 and 50 is provided, by which the paper web 10 is carried away with a predetermined tensile force.

In the case of the infrared fixing, the paper web 10 must not contact mechanical parts between the take-off device 48 and the transfer printing rollers 42 and 44 in order to avoid smearing of the toner image. Therefore, a single-edge sagging of the paper web has to be avoided.

The take-off device 48 can be pivoted about a rotational axis 54 running through the point of rotation 52 in the direction of the double arrow 56. In this way, the tensile stress along the two lateral edges 11 and 13 of the paper web 10 can be varied in order to reduce or avoid a single-edge sagging of the paper web 10.

In addition, the rotary frame 22 is pivotable about a second rotational axis 58 in the direction of the rotational arrow 60. The axis 58 is substantially parallel or identical to the direction of motion of the paper web 10 between the two rollers 24 and 26. In this way, the tension on one edge of the paper web 10 can be increased or reduced and thus a single-edge sagging of the paper web 10 can be avoided.

In FIG. 1*b*, the transport of the paper web 10 through the high-performance printer is shown in a top view. In one alternative, the transport of the paper web 10 takes place such that one lateral edge has a fixed desired position independent of the width of the paper web 10. In the present case, the left lateral edge 11 is fixed as viewed in the transport direction. This lateral edge 11 coincides with the second rotational axis 58. In the present example according to FIGS. 1*a* and 1*b*, a swiveling of the entire rotary frame 22 about the rotational axis 58 takes place by swiveling the frame 28 about a support 62 which is approximately located below the prolonged axis of the rotational axis 58. For this purpose, a screw-nut combination 64 is provided on the opposite side of the support 62, by means of which combination the frame 28 can be swiveled about the rotational axis 58. It is pointed out that the lateral edge 11 can be fixed at other locations with respect to the rotational axis 58, too. Likewise, other devices for swiveling can be used, which operate electrically, hydraulically or pneumatically. The screw-nut combination 64 illustrated merely shows a particularly simple device that can also be manually operated.

The sensors S1 and S2 are preferably implemented as force sensors and measure the forces which the paper web 10 exerts on the axis of the feed roller 20. When the force is reduced on one edge of the paper web 10, then the typical consequence is a sagging of the paper web 10 at this edge. By adjusting the screw-nut combination 64 such a single-edge sagging can be compensated for.

When the lateral edge 11 of the paper web 10 is fixed on one edge, as illustrated in FIG. 1*b*, the paper web 10 does not run centrally with respect to the feed roller 20. This asymmetry also results in the fact that owing to different lever arms along the axis of the feed roller 20 asymmetric forces occur in the sensors S1, S2. The desired values for a possibly necessary correction are likewise asymmetric in this case. They are determined, for example, with the aid of computing programs or by comparative measurement and form the basis for correction data.

The sensors S3, S4 and S5, S6 monitor the marginal regions with the lateral edges 11 and 13 of the paper web 10 and can recognize a single-edge sagging. For example, video cameras can be used as sensors. Another possibility is to detect the web tension in the region of the lateral edges 11 and 13, for example, with the aid of one or more force sensors. Another possibility is to determine the sagging of the respective lateral edge 11 and 13 with the aid of displacement sensors that operate on an optical, inductive and/or capacitive basis.

Figure 2:
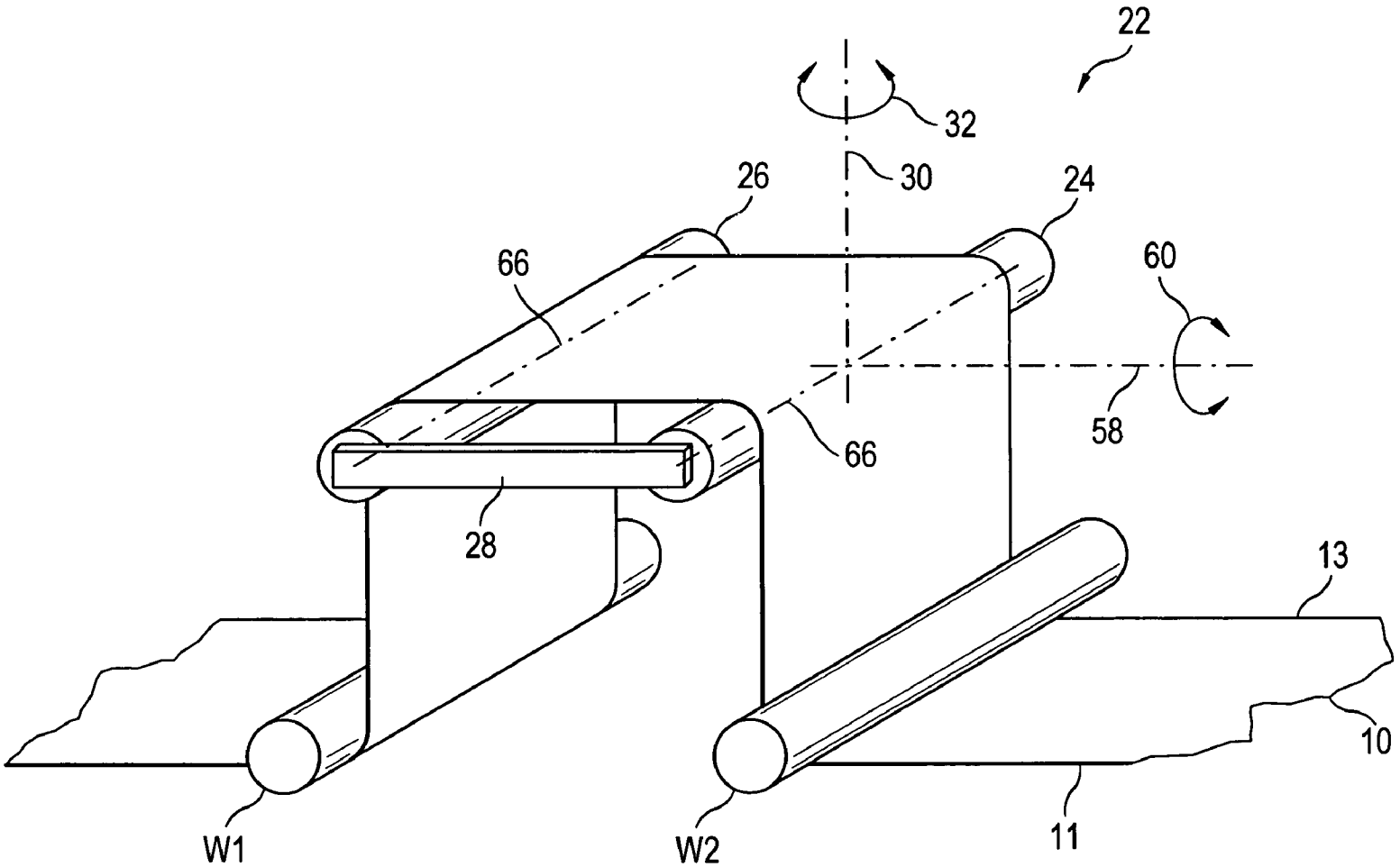
FIG. 2 is a perspective view that shows the fundamental structure of the rotary frame.

FIG. 2 schematically shows the rotary frame 22 with the two rollers 24 and 26, the axes 66 of which run parallel and are supported by the frame 28. By a rotation in the direction of the rotational arrow 32 about the axis 30 with respect to stationary rollers W1 and W2, the position of the lateral edges 11 and 13 of the paper web 10 can be changed in the direction of the roller axes 66. By a swivel motion in the direction of the rotational direction arrow 60 about the axis 58, the web tension within the paper web 10 can be changed on the side of a web edge 11 and 13. In the example according to FIG. 2, the rotational axis 58 lies in the center of the paper web 10. However, it can likewise lie at the edge of the paper web 10 as in the example according to FIG. 1 or even outside the paper web 10.

Figure 3:
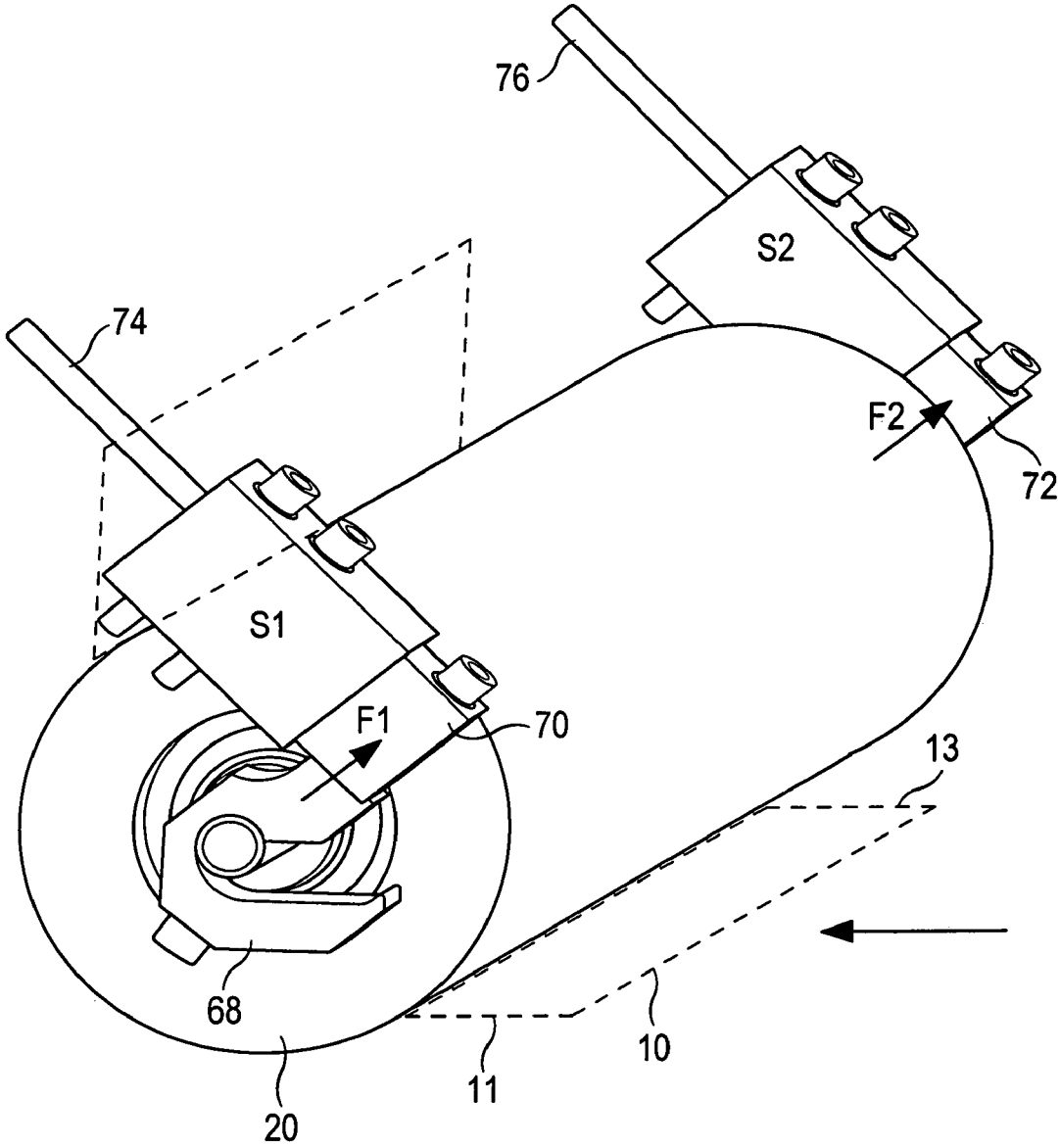
FIG. 3 is a perspective view of a feed roller with web tension measurement.

FIG. 3 shows an example for the measurement of the web tension of the paper web 10 with the aid of the feed roller 20 and the sensors S1 and S2, which are implemented as bending beams with strain gauges for force measurement. The feed roller 20 is mounted on both sides in receptacles 68. These receptacles 68 are firmly connected to the printer housing (not illustrated) by means of mounts (bending beams) 70 and 72. The strain gauges of the sensors S1 and S2 measure the deflection of these mounts 70 and 72 and thus the forces F1 and F2 occurring on both sides of the feed roller 20 and being approximately proportional to the respective web tension in the lateral edges 11 and 13 of the paper web 10 in the case of a symmetrical arrangement of the paper web 10 and the feed roller 20. The sensors S1 and S2 output electric signals via the lines 74 and 76. When the web tension in the region of a lateral edge 11 and 13 of the paper web 10 is smaller than the desired value then the respective force F1 and F2 is likewise smaller than the desired value so that a sagging of this lateral edge 11 and 13 of the web 10 can be inferred therefrom. In the case of an asymmetrical arrangement of paper web 10 and feed roller 20, the lever arms for the respective sensors S1 and S2 along the axis of the feed roller 20 are to be taken into account, i.e. the desired forces are likewise asymmetrical and the forces have to be corrected accordingly.

The measurement of the web tension of the paper web 10 at the feed roller 20, as illustrated, can, of course, also be applied to other rollers within the web transport through the printer so that with a similar arrangement the sagging on one edge of the paper web 10 can be determined at almost any location within the printer.

Figure 4:
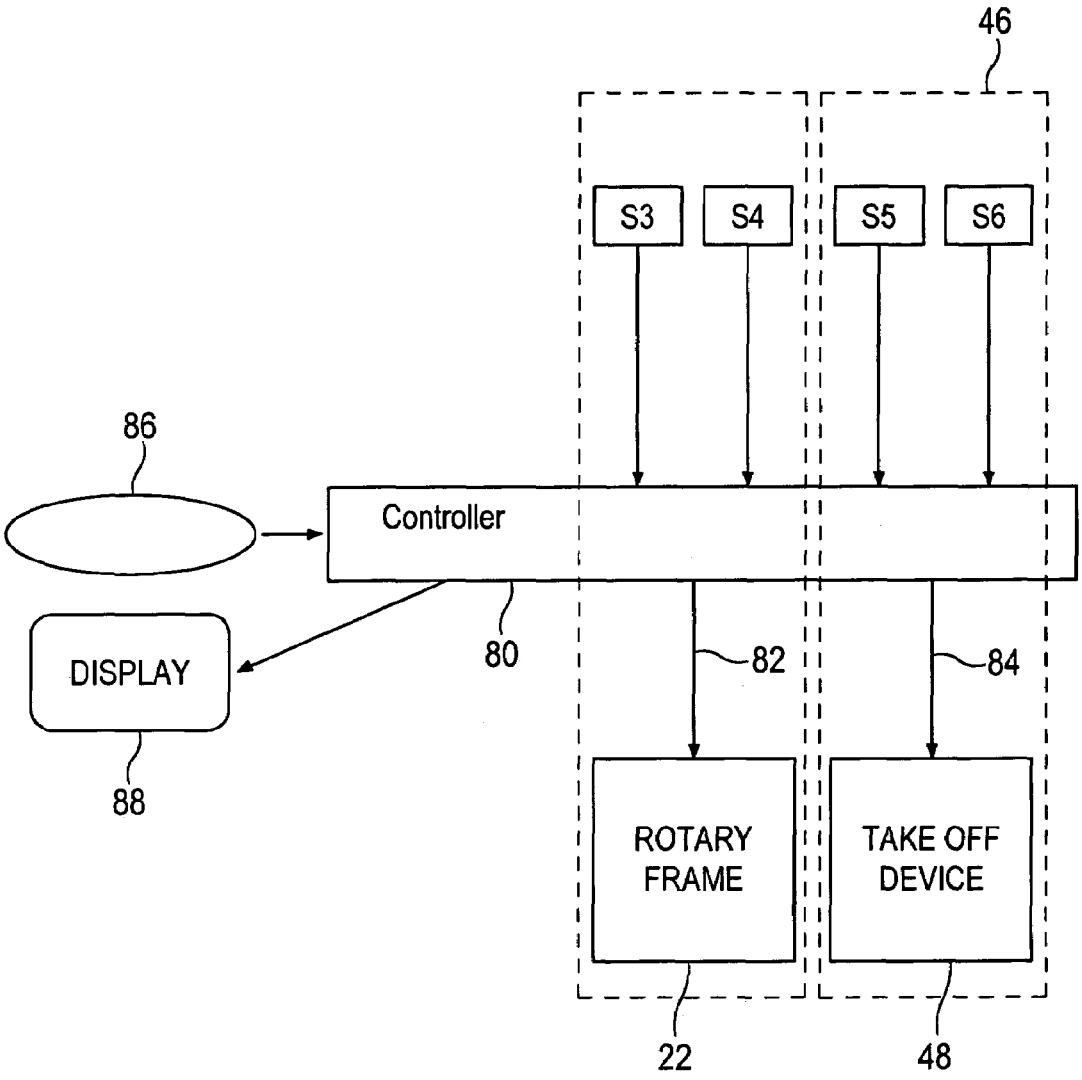
FIG. 4 is a schematic illustration of an apparatus for controlling the web transport according to a first alternative.
Figure 5:
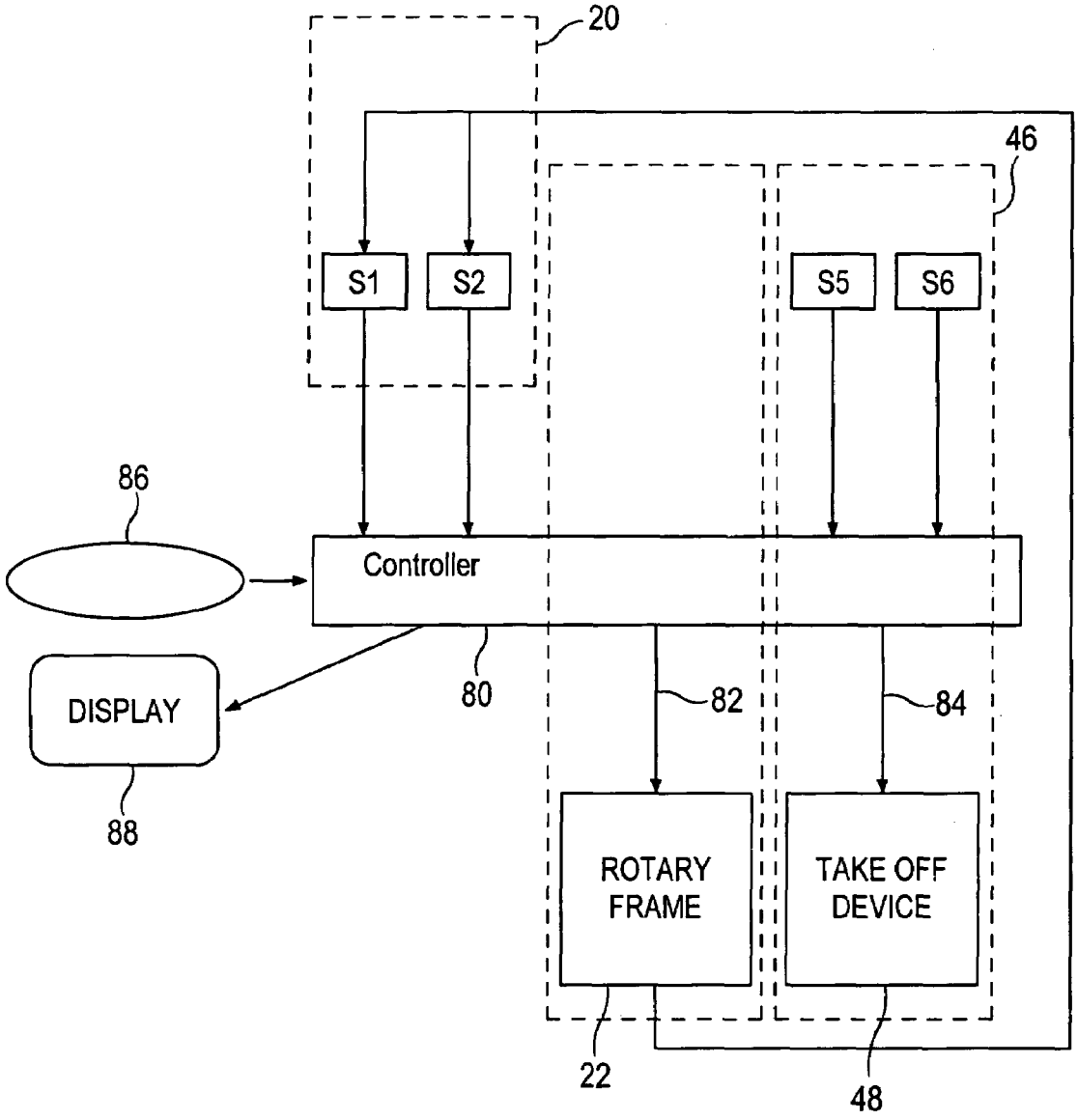
FIG. 5 is a schematic illustration of a control according to a second alternative of the invention.
Figure 6:
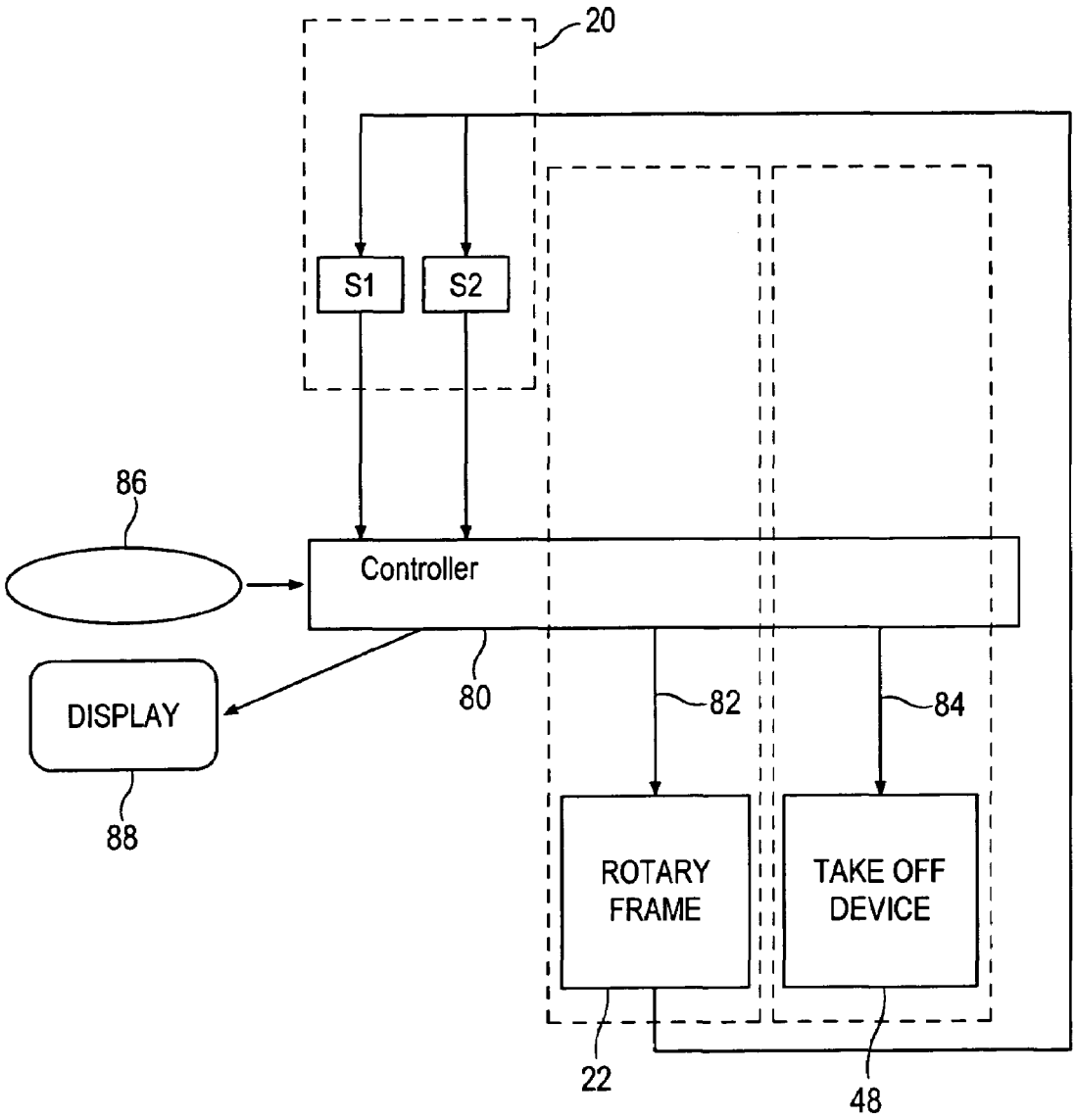
FIG. 6 is a schematic illustration of a control according to a third alternative.

FIGS. 4, 5 and 6 show three alternatives for controlling the web tension in the printer. In the alternative according to FIG. 4, a control of the web tension is performed with the aid of sensors S3 and S4 at the rotary frame 22 as well as with the aid of the sensors S5 and S6 in the region of the fixing station 46. The signals of the sensors S3, S4 and S5, S6 are transferred to a controller 80 that processes the signals in a control algorithm, preferably using software means. This controller 80 then generates control signals 82 and 84 for driving corresponding drives for the rotary frame 22 and the take-off device 48. The closed loop control algorithm processes predetermined desired values 86; the controller 80 further generates information about operating conditions which are displayed on the display 88.

When, in the region of the rotary frame 22, it is determined with the aid of the sensors S3 and S4 that the paper web 10 sags along a lateral edge 11 and 13, then the rotary frame 22 is pivoted about the rotational axis 58, for example, with the aid of an electrically actuated screw-nut combination 64 or by means of other swivel mechanisms. (See FIG. 1*a*) In this way, the paper web 10 is tensioned in the sagging region. In a similar way, a single-edge sagging in the region of the fixing station 46 is detected with the aid of the sensors S5 and S6 and is counteracted or, respectively, completely compensated by swiveling the take-off device 48 about the rotational axis 54 corresponding to the point of rotation 52 along the double arrow 56. (See FIGS. 1*a* and 1*b*) In this way, a single-edge sagging is likewise corrected in the fixing region. In the first alternative described, thus a single-edge sagging in the region of the rotary frame 22 and in the region of the fixing station 46 is corrected. This can be achieved with the aid of control algorithms that are stored in the controller. However, a closed loop control can be effected such that the controller is given desired values which are compared with the actual values of the sensors S5, S6 and S3, S4, a deviation being corrected by deflecting the rotary frame 22 or, respectively, the take-off device 48.

According to the second alternative illustrated in FIG. 5, in which same parts have the same reference signs, the signals of the sensors S1 and S2 in the region of the feed roller 20 and of the sensors S5 and S6 in the region of the fixing station 46 are evaluated for correcting the web tension. With the aid of the signals of the sensors S1 and S2, a web tension decreasing along a web edge 11 and 13 of the paper web 10 is detected, which is interpreted as a single-edge sagging of the paper web 10. The rotary frame 22 is then controlled such that it counteracts this decrease in web tension on this edge of the paper web 10. With the aid of a closed-loop control algorithm, the swiveling of the rotary frame 22 about the rotational axis 58 (see FIG. 1*b*) takes place such that predetermined forces are achieved for the sensors S1 and S2. The setting of the web tension with the aid of the sensors S5 and S6 takes place as described for the alternative according to FIG. 4. In this alternative, too, a single-edge sagging of the paper web is corrected or, respectively, avoided in the region of the rotary frame 22 and in the region of the fixing station 46.

In the alternative according to FIG. 6, a monitoring of the paper web 10 is only effected with the aid of the sensors S1 and S2 which are arranged in the region of the feed roller 20. Assuming that the conveying rollers for the paper web transport are in a parallel basic setting with regard to all axes, a single-edge sagging of the paper web 10 can only result from the irregular mechanical web properties of the paper web 10. Thus, the signals of the sensors S1 and S2 provide an information about the paper web properties, for example whether the paper web is curved, has a varying density or varying tensions along the axes of its surface. With the aid of experimental values determined in tests and comparative measurement operations, a corresponding deflection of the rotary frame 22 about the axis 58 (see FIGS. 1*a* and 1*b*) and/or a corresponding deflection of the take-off device 48 about the rotational axis 52 can take place for each tuple of values of the sensors S1 and S2 in which also the web width and the type of paper is taken into account. Typically, such tuples of values and the associated control parameters for the required deflection of the rotary frame and the take-off device 48 are stored in a memory in the form of a table. In this alternative the sensor expense is reduced to a minimum, a high quality paper web guidance being nevertheless achieved in the printer. Of course, the described alternative according to FIG. 6 can be combined with the alternatives according to FIG. 4 or FIG. 5, i.e. the signals of the sensors S3, S4 and/or S5, S6 can additionally be used for controlling the web tension of the paper web 10.

According to a fourth alternative, a monitoring of the web tension and a correction only take place in the region of the fixing station 46 in order to avoid a damaging single-edge sagging of the paper web. With the aid of the sensors S5 and S6 and the pivotable take-off device 48, a stable web guidance is achieved for the relatively long path of a fixing station 46 operated with infrared radiation.

Figure 7:
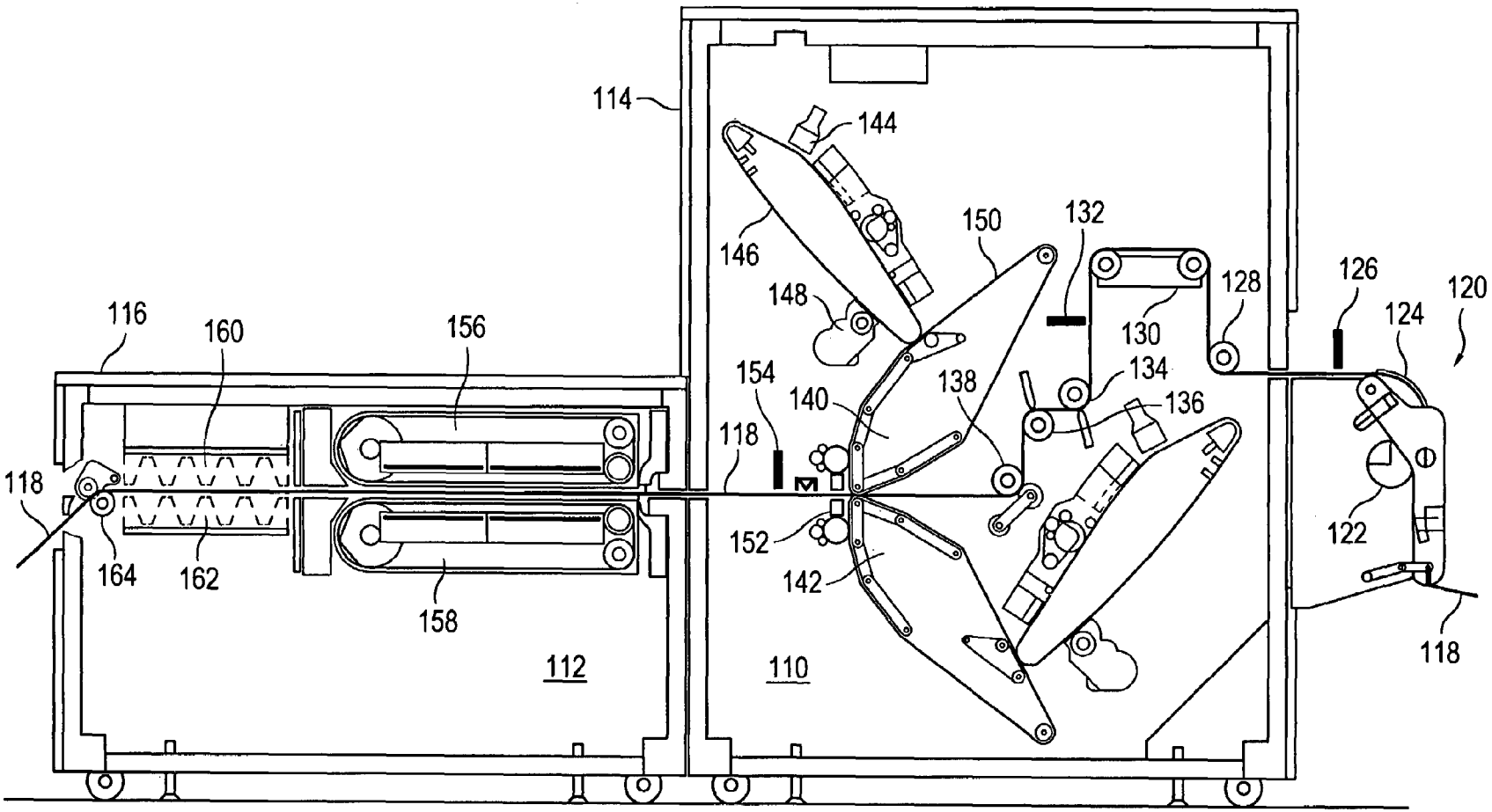
FIG. 7 is a side view which shows the fundamental structure of an electrographic printer in which a web guidance is implemented.

According to a further aspect of the invention, in FIGS. 7 to 13 examples are described which can likewise be combined with the afore-mentioned examples. In FIG. 7, a high-performance printer is illustrated, in which the device and the method according to the invention are implemented. The printer is divided into a printing unit 110 and a fixing station 112, which have their respective independent housings 114 and 116 that are connected to one another. A web 118 of continuous paper is guided through both housings 114 and 116. In a web feed region 120 for the printing unit 110, a web retracting motor 122 is provided which exerts a restraining force on the web 118 with the aid of a roller pair. Further, a web brake 124 is provided which smoothes the web 118 and likewise exerts a restraining force on the web 118. The web brake 124 is, for example, implemented in the form of a felt that rests on the web 118. Another possibility is to use a vacuum brake. With the aid of a varying vacuum, the paper web is charged with a vacuum on the underside, i.e. drawn-in, and accordingly the friction changes. In the web feed region of the retracting device 120, more precisely shortly downstream the web brake 124 as viewed in normal transport direction, a second sensor 126 is provided which senses the actual position of the lateral edge of the web 118.

The web 118 is supplied via a deflection roller 128 to a rotary frame 130 which serves as an actuator for adjusting the position of the lateral edge of the web 118. The rotary frame 130 performs rotational movements about an axis running perpendicularly to the web 118 and thereby displaces the lateral edge in a direction perpendicular to the paper plane of FIG. 7. In the outlet region of the rotary frame 130, a first sensor 132 is provided which senses the actual position of the lateral edge of the web 118. The web 118 is supplied via two further deflection rollers 134 and 136 to a web drive 138 which includes a roller pair. The web drive 138 advances the web 118 in transport direction against the restraining force of the web brake 124.

In the further course, an upper transfer printing station 140 and a lower transfer printing station 142 are arranged on both sides of the web 118. Both transfer printing stations 140 and 142 print the upper side and the underside of the web 118 simultaneously with toner images. Both transfer printing stations 140 and 142 are substantially identically structured and this is why only the upper transfer printing station 140 will be explained in more detail in the following. The upper transfer printing station 140 comprises a character generator 144 that generates an electrostatic charge image corresponding to a print image to be printed on a photoconductor belt 146. An upper developer station 148 inks the electrostatic charge image with toner material; the toner images are then transferred onto a transfer belt 150. In the further course, the toner images present on the transfer belt 150 are transferred onto the web 118 at the transfer printing location 152, i.e. at the transfer printing location 152 toner images are transfer-printed simultaneously by both transfer printing stations 140 and 142.

Following the transfer printing location 152, as viewed in transport direction, a third sensor 154 is provided, which likewise senses the actual position of the lateral edge of the web 118. The toner images on the web 118 which are not fixed yet, are supplied to the fixing station 112 where they are fixed on both sides of the web in infrared fixing devices 156 and 158 and are cooled by fans 160 and 162 provided downstream thereof. In the exit region of the fixing station 112, a web take-off motor 164 is provided which acts on a rotary roller pair and conveys the web 118 out of the fixing station 112.

The high-performance printer illustrated has various operating conditions in which different functions with regard to a position control of the lateral edge of the web 118 are respectively performed:

Operating Condition 1: Automatic Web Insertion

Upon a new insertion of a web 118, this is automatically conveyed further through the printing unit 110 and through the fixing station 112 with the aid of a clamp and is transported from there to the web exit. During the guidance of the web 118 with the aid of the clamp, the rotary frame 130 and the position control remain inactive. After the insertion has been completed, the rotary frame 130 and the position control are activated.

Operating Condition 2: Insertion of a Glued-On Web

When a new web is glued onto a preceding web, then the new web is guided through the printing unit 110 and the fixing station 112 at a transport speed that is considerably slower than the normal printing speed so as to not stress the glued joint too much. During the transport of the glued joint through the printer a control adapted to the slow transport speed is active. Owing to the glued joint between the old web and the new web, position deviations can occur at the lateral edge. Here, the control function is that a settling to the desired position of the lateral edge of the web 118 has to take place as quick as possible. When the insertion has been completed, the normal position control is activated.

Operating Condition 3: Slow Forward Transport and Backward Transport of the Web

In order to position the web as accurately as possible when inserting pre-printed paper (form paper), a slow forward and backward transport is required. During this positioning, the control and the rotary frame 130 are inactive. After this fine positioning has been completed, the control and the rotary frame 130 are activated by the following paper motion, and the lateral edge of the web 118 is to be brought into the desired position as quick as possible (as in the case of the operating condition 4 and 5 described below). What is important during this operation is that as little as possible printed wastepaper, i.e. spoilage, is produced.

Operating Condition 4: Fast Forward Transport Without Printing Operation

Towards the end of a print job, the web is to be held in the desired position with respect to the lateral edge at a defined printing speed, however without there being a printing operation so that the toner images that have been transfer-printed last can be fixed in the fixing station 112. Towards the end of the forward motion of the web 118, a retracting motion is initiated so that a re-start of the operation can be carried out in a manner suitable for the form, i.e. the print images have to be printed on the web 118 in a positionally accurate manner with respect to a form. During this forward and backward motion of the web, the control and the rotary frame 130 are active; it is to be achieved that the desired position of the lateral edge of the web is to be reached as quick as possible, as a result whereof only a few pages of wastepaper are produced.

Operating Condition 5: Web Transport During Printing Operation

During the start of the printing operation the web 118 is first accelerated to the desired speed corresponding to the printing speed, with the transfer printing stations 140 and 142 being swiveled away. Subsequently, the transfer printing stations with the transfer belts are swiveled in and the printing is effected. At the end of a printing operation with a forward motion of the web, a retracting transport of the web 118 is carried out with the transfer printing stations being swiveled away, so that a re-start of the printing process can take place in a manner that is suitable for the form. In this operating condition, the control and the rotary frame 130 are active. A fast settling of the lateral edge to the desired position within the various transport speeds of the web 118 is to take place.

Figure 8:
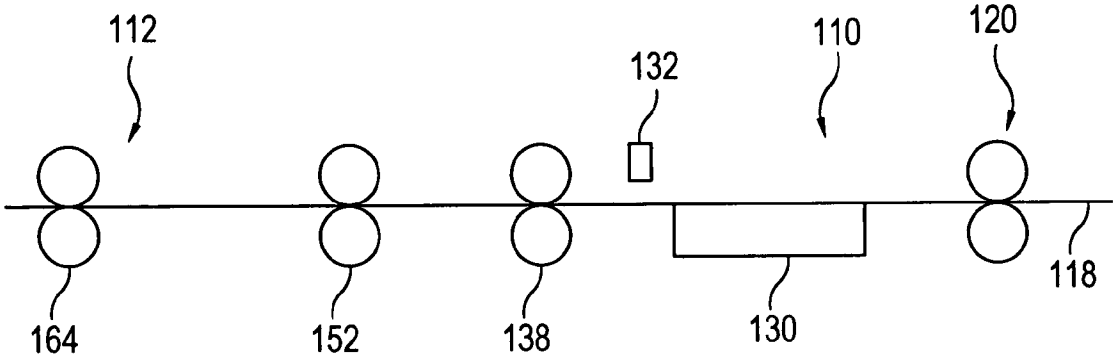
FIG. 8 is a schematic view of an arrangement comprising a first sensor for sensing the lateral edge of the web.

On the basis of a first example with only one sensor 132, FIG. 8 schematically shows the course of the web 118 within the devices 110 and 112, as is substantial for the control of the position of the lateral edge. The web 118 is conveyed via the web feed region 120, symbolized by a roller pair, to the rotary frame 130, in the web outlet of which the first sensor 132 is arranged. Subsequently, the web 118 is guided along the web drive 138, the transfer printing location 152 and the take-off device 164.

Figure 9:
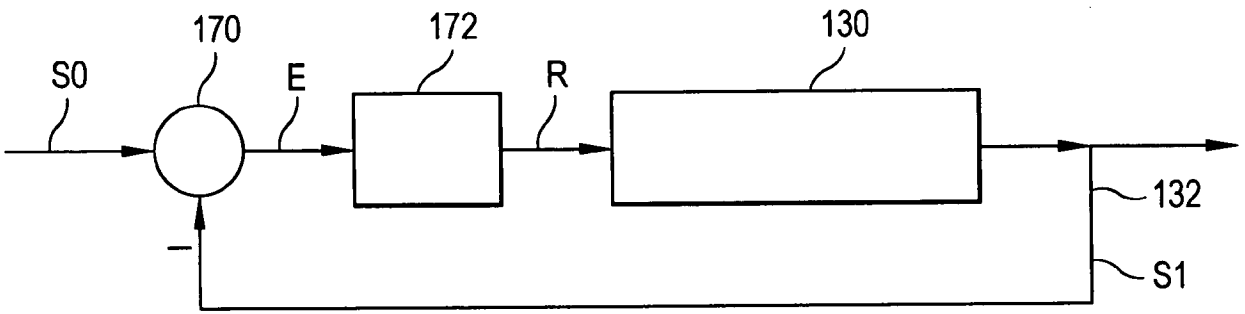
FIG. 9 is a block circuit diagram of the closed loop control circuit for controlling the position of the lateral edge.

FIG. 9 shows a block circuit diagram with regard to the first embodiment of the position control. The actual signal S1 of the first sensor 132 is fed to an adder 170 and the control deviation E is formed. A controller 172, for example a PID (Proportional Integral Differential) controller generates a control signal R which is fed to an actuator of the rotary frame 130. The rotary frame 130 changes its angle of rotation due to the control signal R and thus changes the lateral position of the lateral edge of the web 118. The actual position of this lateral edge is acquired by the first sensor 132 as an actual signal S1, which, as mentioned, is fed back to the adder 170. This closed loop control operation is repeated until the control deviation E is equal to zero. The desired position as determined by the desired signal S0 that is fed to the adder 170 as an electric signal is fixed at the location of the first sensor.

The first sensor 132 determines measured values at predetermined distances along the web 118. An average of these measured values is used as an actual signal S1. Preferably, a moving average or an exponential average is used as an average. For the moving average, first an average from n measured values is formed. For each new additional measured value, a new average is calculated from the previous average and the new measured value. The desired value S0 can be determined in a similar way in a comparative measurement operation. Preferably, the average is determined over a predetermined distance of the web, in general a whole-numbered multiple of a standard format length of a print page. Typically, the 12-inch format is used as a standard format length, the multiple preferably being 3.

Owing to the averaging, short-wave position deviations along the web edge do not result in undesired deflections of the rotary frame. Moreover, excessive position deviations at the transfer printing location owing to resonance are avoided by the averaging. Such position deviations owing to resonance can occur with paper webs having lateral edges that are cut in wavy forms. By adjustment to the standard format length, along printed lines in print images no waviness occurs in transport direction of the web within a form length.

In this first embodiment it may be problematic that only at the location of the first sensor 132, i.e. near the rotary frame 130, the actual position corresponds to the desired position of the lateral edge. At the transfer printing location 152, which is essential for the print quality, the lateral edge of the web 118 can again deviate from a desired position. Due to the averaging, moreover, the settling behavior can be relatively slow. In addition, due to the averaging, a control deviation can still remain since maximum amplitudes are not corrected.

Figure 10:
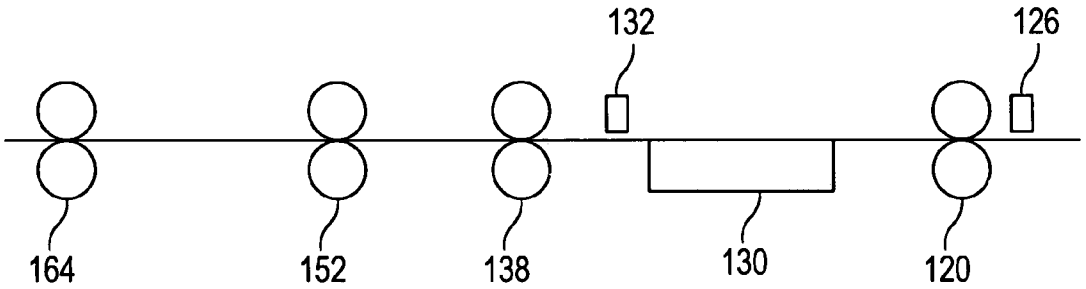
FIG. 10 is a schematic view which shows a structure with an additional second sensor in the feed region of the web.

FIG. 10 shows a further embodiment in which two sensors are provided. The same parts have the same reference signs. The second sensor 126 is provided in the web feed region 120. The rest of the arrangement corresponds to that shown in FIG. 8.

Figure 11:
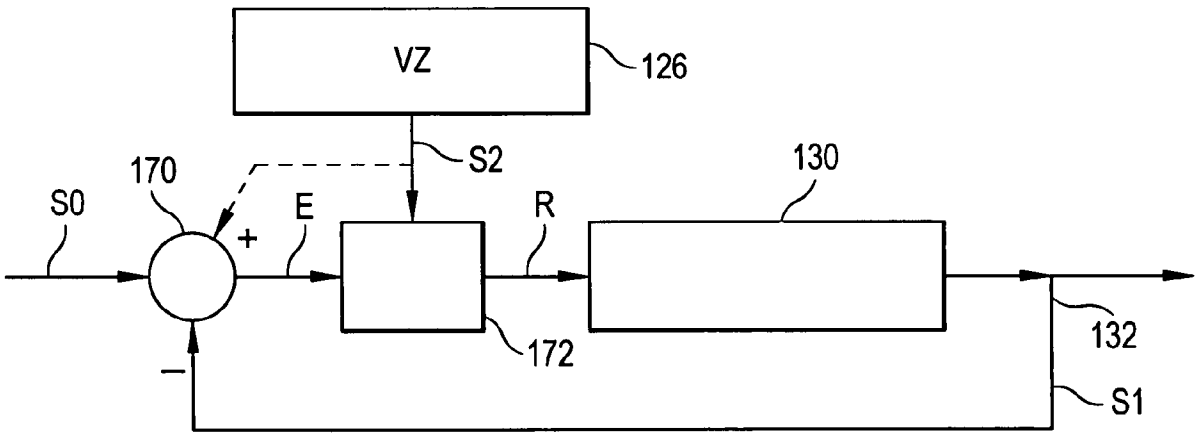
FIG. 11 is a block circuit diagram of the position control with two sensors.

FIG. 11 is a block circuit diagram of the associated position control for the lateral edge of the web 118. With the aid of the signal S2 of the second sensor 126, the controller 172 is influenced to output the control variable R to the rotary frame 130. The second sensor 126 reflects in its signal S2 the deviation of the position of the lateral edge of the web 118 in the web feed region 120, i.e. it determines the deviation of the actual position of the lateral edge from a desired position in the region of the web brake 124 (see FIG. 7). For this purpose, it is necessary that in the web feed region 120 a web supply means is provided that has a lateral stop (not illustrated) along which the relevant lateral edge of the web 118 is guided. In this way, a stable starting position is created for the lateral edge of the web in the feed region of the web 118.

The second sensor 126 preferably includes a delay element VZ. The delay time for the signal S2 corresponds to the time which the web 118 requires during the transport from the location of the second sensor 126 to the location of the first sensor 132. In this way, the deviation of the lateral edge from a desired value in the web feed region 120 can be compensated for in a time-delayed manner. Thus, the deviation of the lateral edge from a reference value in the web feed region is determined and, as a first alternative, the signal S2 is added to the desired value S0 (illustrated in broken lines in FIG. 11). As a second alternative, the signal S2 is directly supplied to the controller 172, which forms the control variable R taking into account this signal S2. In this embodiment according to FIG. 11, no averaging is carried out for the signal S1 of the first sensor 132, since it would disturb the compensation with the aid of the signal S2.

The advantage of the position control according to FIG. 11 is that only the long-wave deviations of the medium actual position of the lateral edge from a desired position at the location of the first sensor 132 are compensated for by the rotary frame 130. By taking into account a deviation of the lateral edge in the feed region of the web 118, the settling behavior of the closed loop control circuit is relatively quick. In this example according to FIG. 11, too, it has to be pointed out that the control deviation at the location of the first sensor 132 can be minimal, however at the transfer printing location 152 deviations from an optimum position of the lateral edge can occur.

Figure 12:
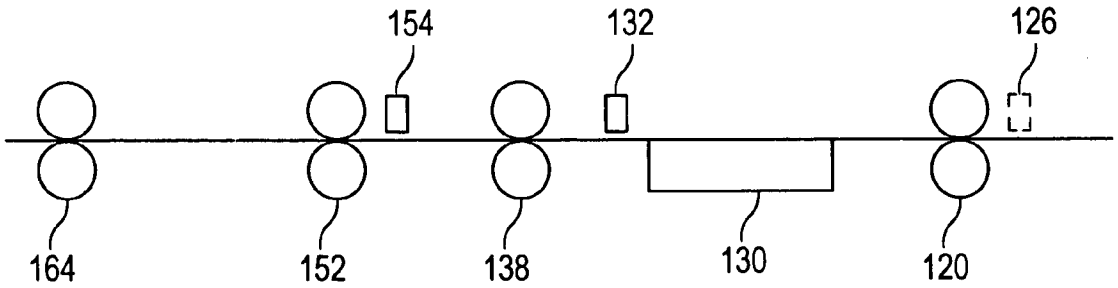
FIG. 12 is a schematic diagram which shows the fundamental structure with three sensors.

FIG. 12 schematically shows the structure with three sensors 126, 132 and 154. The second sensor 126 is optional, this being indicated by broken lines. The third sensor 154 is arranged within a region of±100 mm relative to the transfer printing location 152 of the transfer printing stations 140 and 142, since the transfer printing location 152 itself is relatively difficult to access.

Figure 13:
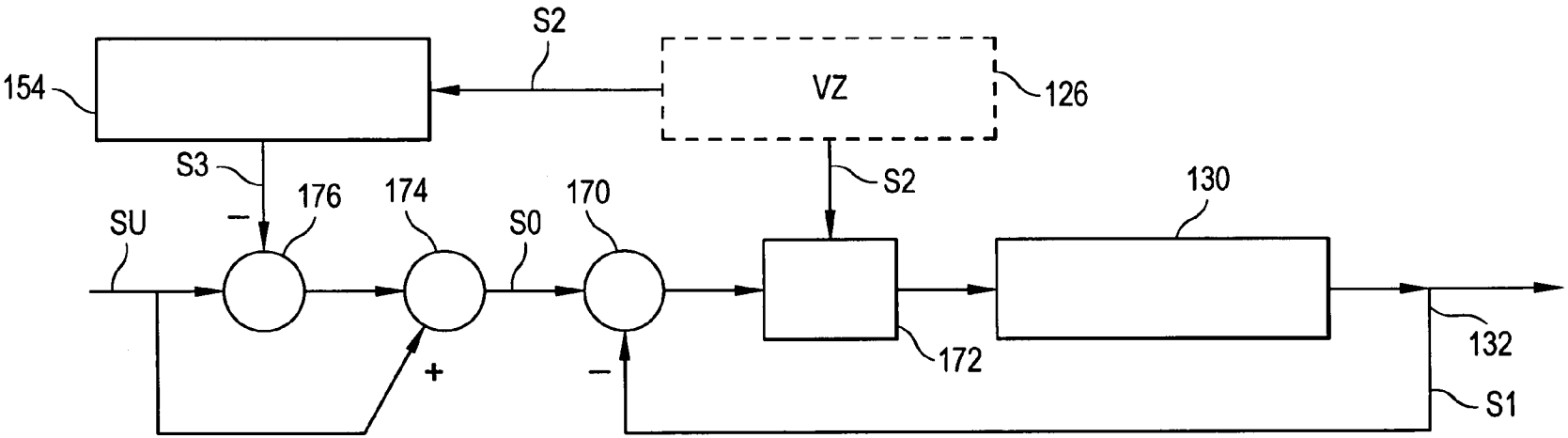
FIG. 13 is block circuit diagram of the position control in which the signals of the three sensors are taken into account.

FIG. 13 shows the associated position control using the signals S1 of the first sensor, S3 of the third sensor and optionally the signal S2 of the second sensor. The position control includes adders 174 and 176 in addition to the adder 170. The signal SU is fed to the adder 176, which signal reflects the desired position at the sensor 154, i.e. near the transfer printing location 152. The adder 176 carries out a desired value/actual value comparison between the signals SU and S3. The result is fed to the adder 174, the result of which is in turn fed to the adder 170. At the adder 170, the actual value S1 of the first sensor 132 in the region of the rotary frame 130 is taken into account. As in the example according to FIG. 5, the signal of the second sensor S2 can optionally be taken into account as a delayed signal at the controller 172 or at the adder 170 (this alternative is not illustrated). Optionally, the signal S2 can also be taken into account in the formation of the signal S3, i.e. the signal S2 influences the third sensor 154.

With the aid of the closed loop control according to FIG. 13, it is possible to take into account the position deviation directly at the transfer printing location 152. The signal S3, possibly taking into account the signal S2, forms, after the operation in the adders 176 and 174, the desired signal S0 for the closed loop control circuit comprising the adder 170. In order to keep the closed loop control system free of oscillations, the signal S0 may only change slowly, for example slower than the signal S1 by the factor 110. The advantage of the arrangement according to FIG. 13 is that a deviation of the lateral edge in the region of the transfer printing location 152 is also recognized and is corrected by the rotary frame 130.

Figure 14:
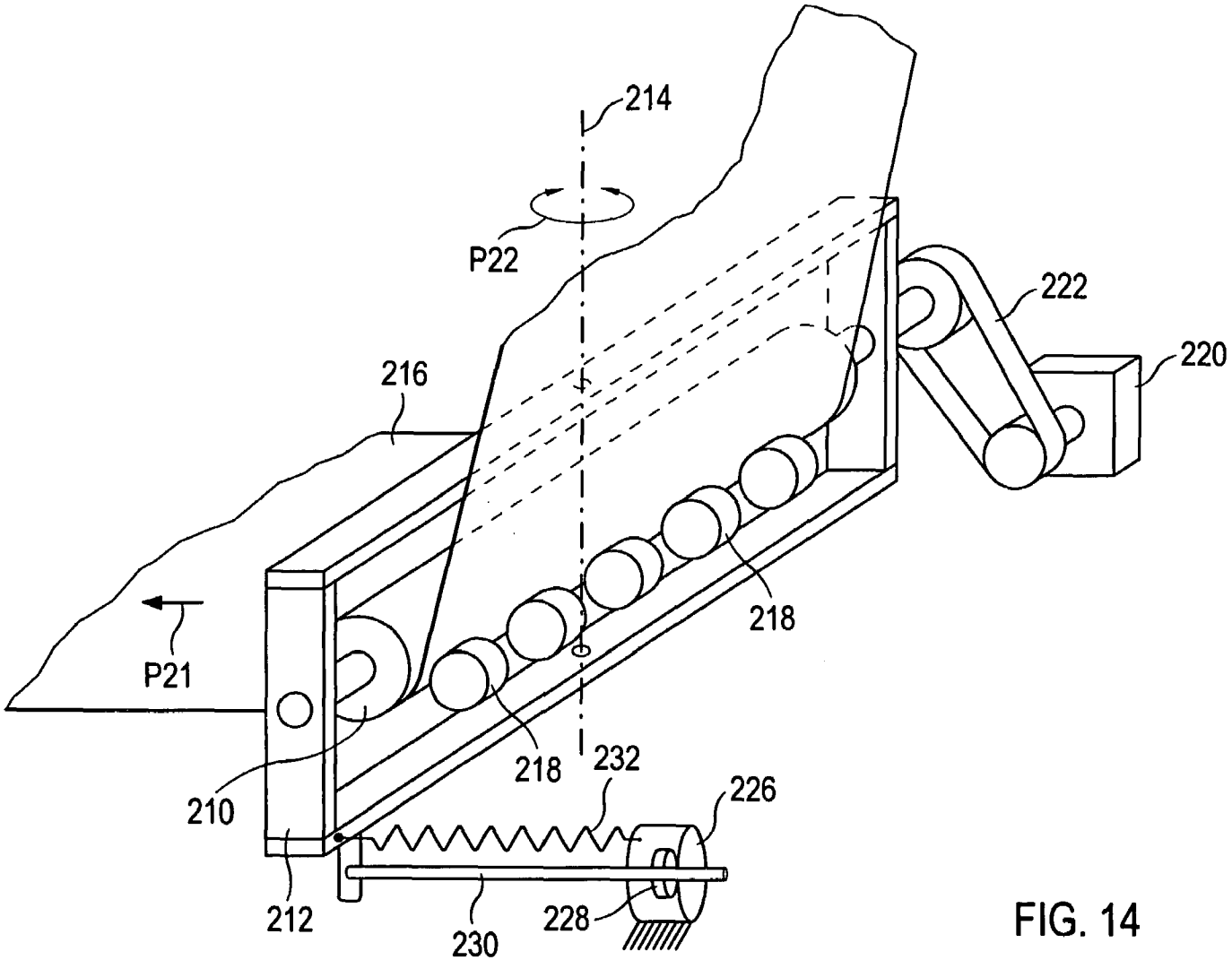
FIG. 14 is a perspective view which shows a rotary frame with a single driven roller and counter-pressure rollers.

In FIGS. 14 to 24 examples of a rotary frame are shown in accordance with a further aspect of the invention. These examples can be combined with the above-described examples. In FIG. 14, a web guiding device is illustrated having a single driven roller 210 mounted in a rotary frame 212. The rotary frame 212 can be pivoted about a rotational axis 214 which runs substantially perpendicularly to the passing web 216. Within the rotary frame 212, counter-pressure rollers 218 are also mounted which press the web 216 against the roller 210 with a predetermined force. The roller 210 is driven with the aid of a drive 220 and a transmission 222. Due to the friction on the surface of the roller 210, the web 216 is conveyed in the direction of the arrow P21. The web 216 is moved in a tangential direction from the generated surface of the roller 210. By pivoting the rotary frame 212 in the direction of the arrow P22 about the axis 214 by an angle α, the transport direction of the web 216 that is transported by the roller 210 is likewise influenced. Accordingly, the position of the edge of the web 216 with respect to a reference position can be changed in the direction of the roller axis of the roller 210.

For pivoting the rotary frame 212, for example, an electric drive 226 can be used that deflects the rotary frame 212 by small angular amounts, typically by 1° corresponding to the arrow P22 in a clockwise direction or in a counterclockwise direction. The drive 226 includes a nut 228 in which a threaded shaft 230 is moved back and forth. In order to guarantee defined positions during the deflection of the rotary frame 212, the play that cannot be avoided in the drive between the nut 228 and the threaded shaft 230 due to tolerances is prevented by a tension spring 232. What is achieved as a result thereof is that the nut 228 always rests on the same threaded shaft side when the threaded shaft 230 is moved back and forth.

Only minimum forces are applied to the passing web 216 in the case of a rotational movement in the direction of the arrow P22. However, it is likewise possible to arrange the rotational axis 214 eccentrically with respect to the rotary frame 212. In the example according to FIG. 14, the web 216 is guided centrally with respect to the roller 210. However, it is also possible to arrange the web 216 eccentrically.

Further, in the example according to FIG. 14, the web 216 is narrower than the roller 210. However, it is likewise possible to guide this web 216 beyond one side or beyond both sides of the roller 210 so that the width of the roller 210 is smaller than the width of the web 216.

Figure 15:
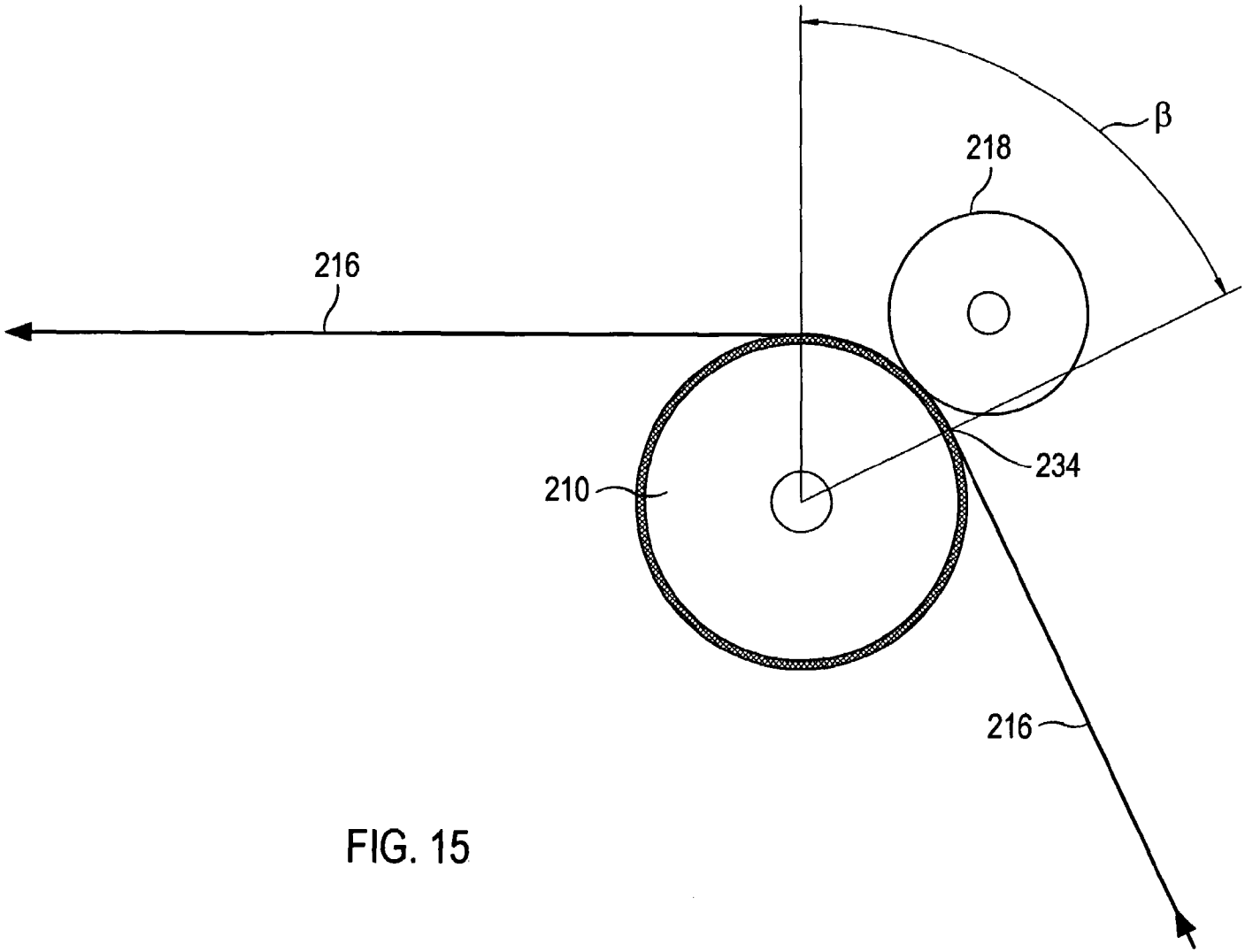
FIG. 15 is a schematic view according to FIG. 1 in cross-section.

FIG. 15 schematically shows the arrangement according to FIG. 14 in cross-section. The web 216 is in contact with the surface of the roller 210 for a predetermined angle of contact β. Typically, the angular range for the angle of contact lies between 3° and 80°. The greater the angle of contact, the higher the frictional engagement with the surface of the driven roller 210.

The angle of contact β defines the length of the zone of contact 234 in which the web 216 is in contact with the surface of the roller 210. This zone of contact 234 has a smoothing effect on the supplied web 216, this reducing the chance of creasing of the web 216 when the roller 210 is pivoted. The smoothing effect can be increased when the point of contact between the counter-pressure roller 218 and the web 216 lies at the end of the angle of contact β as viewed in running direction of the web 216.

The roller 210 has a friction coating on its surface, for example made of a closed-cell PUR (polyurethane) material having a hardness of about 80 Sh A hardness. The spring-loaded counter-pressure rollers 218 result in a substantially slip-free transmission of the driven roller 210 onto the web 216. By a defined setting of the pressure forces of the counter-pressure rollers 218 on the driven roller 210, denting or damaging of the surface of the roller 210 is avoided and thus a constant surface speed of the web 216 is guaranteed. The counter-pressure rollers 218 have a coating of a softer material than the roller 210. For example, the coating is made of a foamed PUR material having a hardness of about 50 Sh A hardness.

Figure 16:
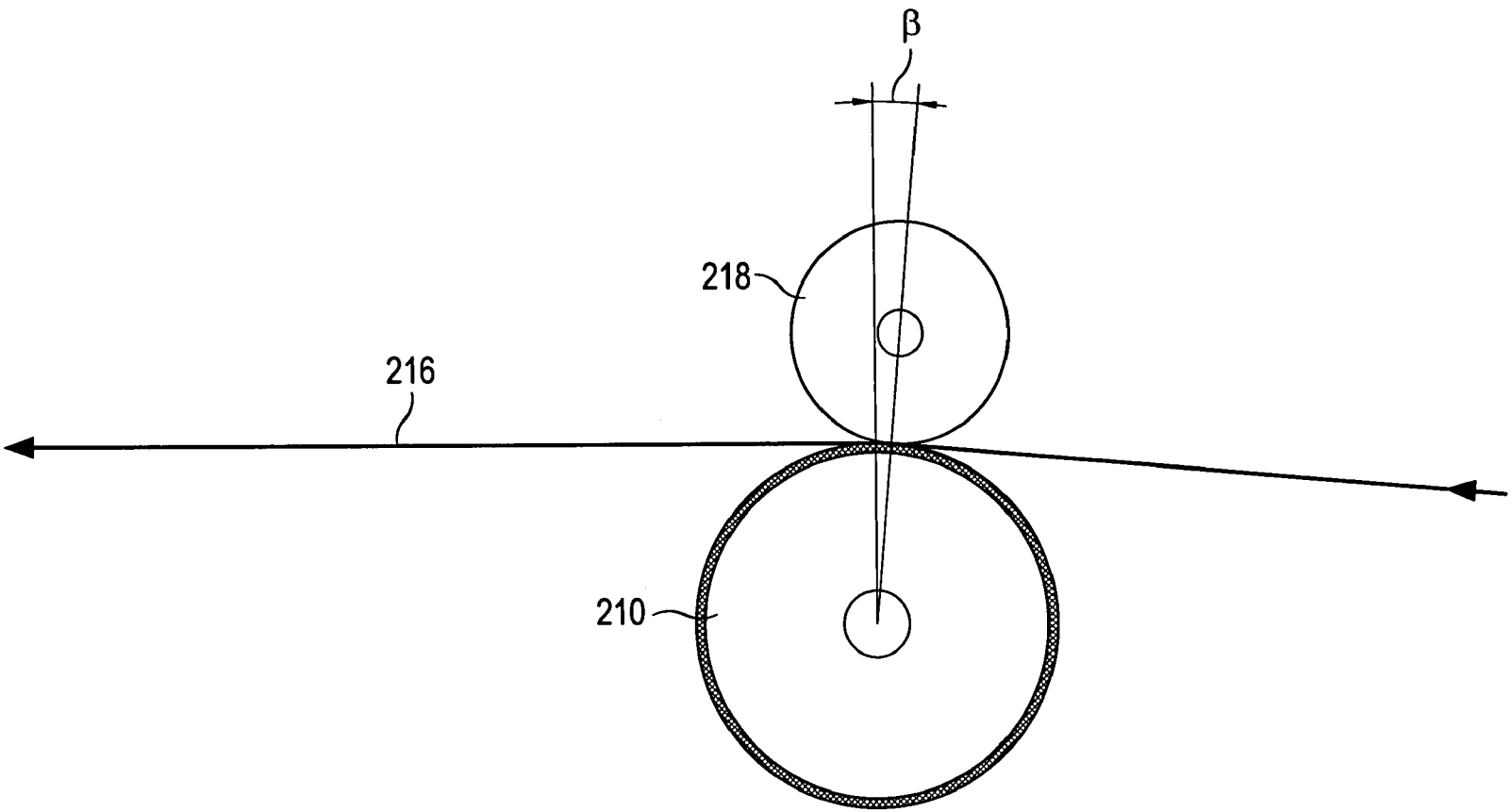
FIG. 16 is a schematic diagram which shows an example with a small angle of contact.

FIG. 16 shows an example with a small angle of contact β. With such an angle of contact, too, a position displacement of the web 216 can still be achieved by pivoting the rotary frame.

Figure 17A:
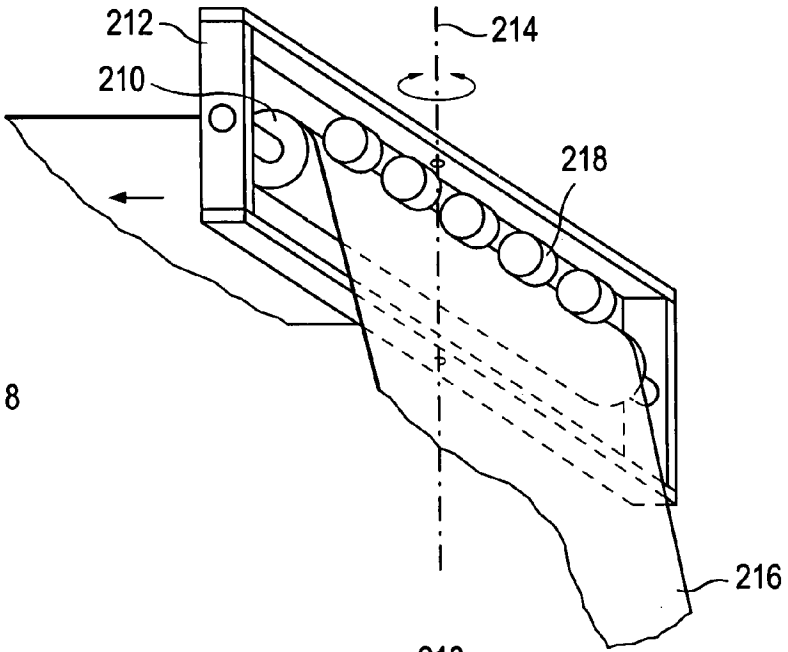
FIGS. 17*a*, 17*b*, 17*c*, 17*d* and 17*e* show examples, in which the rotational axis of the frame is perpendicular to the web that is conveyed off.
Figure 17B:
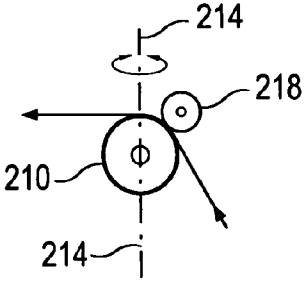
Figure 17C:
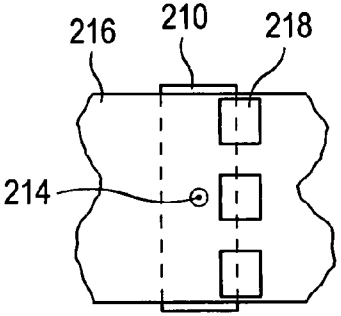
Figure 17D:
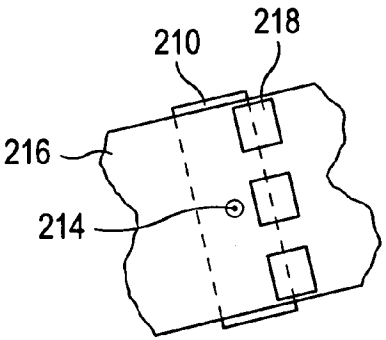
Figure 17E:
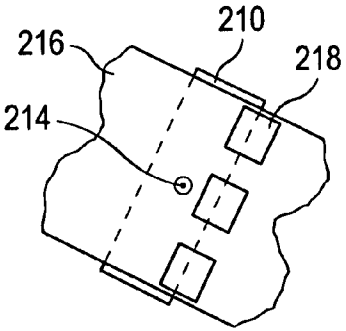

FIGS. 17*a*, 17*b*, 17*c*, 17*b*, and 17*e* show an example, in which the web 216 is supplied from below. The rotational axis 214 is still perpendicularly to the conveyed-off web 216, as can be seen with reference to the FIGS. 17*a* and 17*b*. The FIGS. 17*c*, 17*d* and 17*e* show the web guidance in top views with various pivot angles α with respect to a normal position with 0°.

Figure 18A:
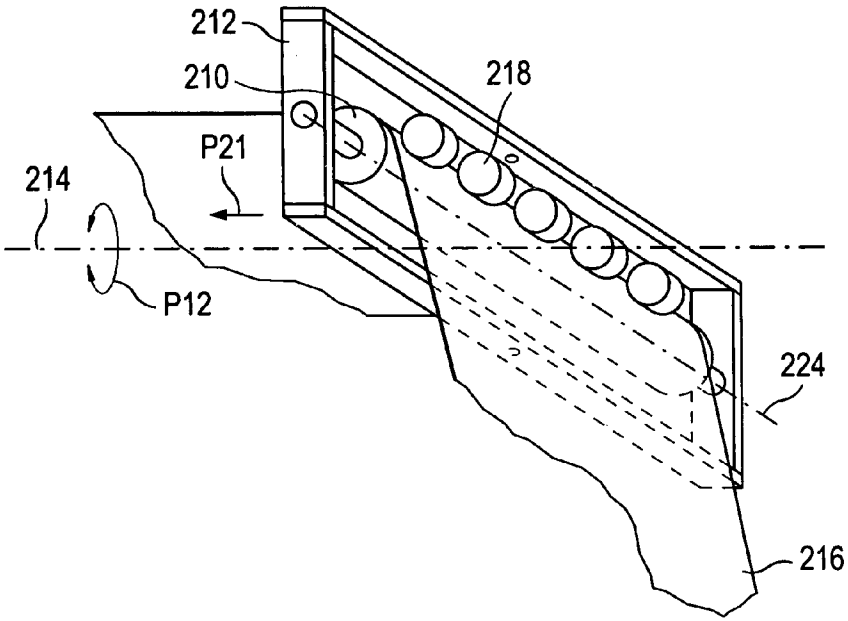
FIGS. 18*a*, 18*b*, 18*c*, 18*d* and 18*e* show examples, in which the rotational axis runs parallel to the direction of motion of the web that is conveyed off.
Figure 18B:
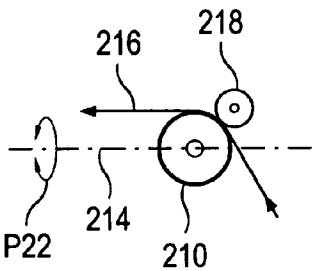
Figure 18C:
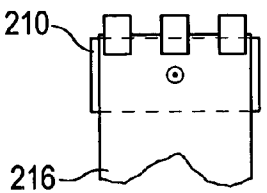
Figure 18D:
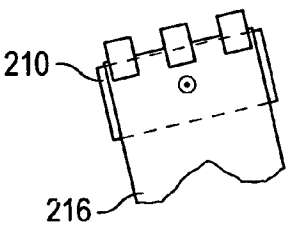
Figure 18E:
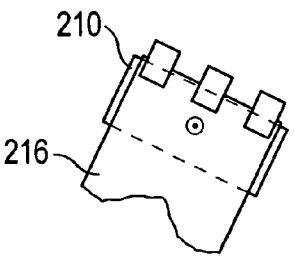

FIGS. 18*a*, 18*b*, 18*c*, 18*d* and 18*e* show an example in which the rotational axis 214 is parallel to the direction of transport of the conveyed web 216. In the case of a rotation by the angle of rotation P12, a change in position of the web 216 in the direction of the axis 224 of the roller 210 likewise takes place. The FIGS. 18*a* and 18*b* illustrate the arrangement with a rotational axis 214 that is parallel to the direction of transport of the web 216. The FIGS. 18*c*, 18*d* and 18*e* illustrate various deflections in the direction of the angle of rotation P22, as viewed in the direction of the rotational axis 214.

Figure 19:
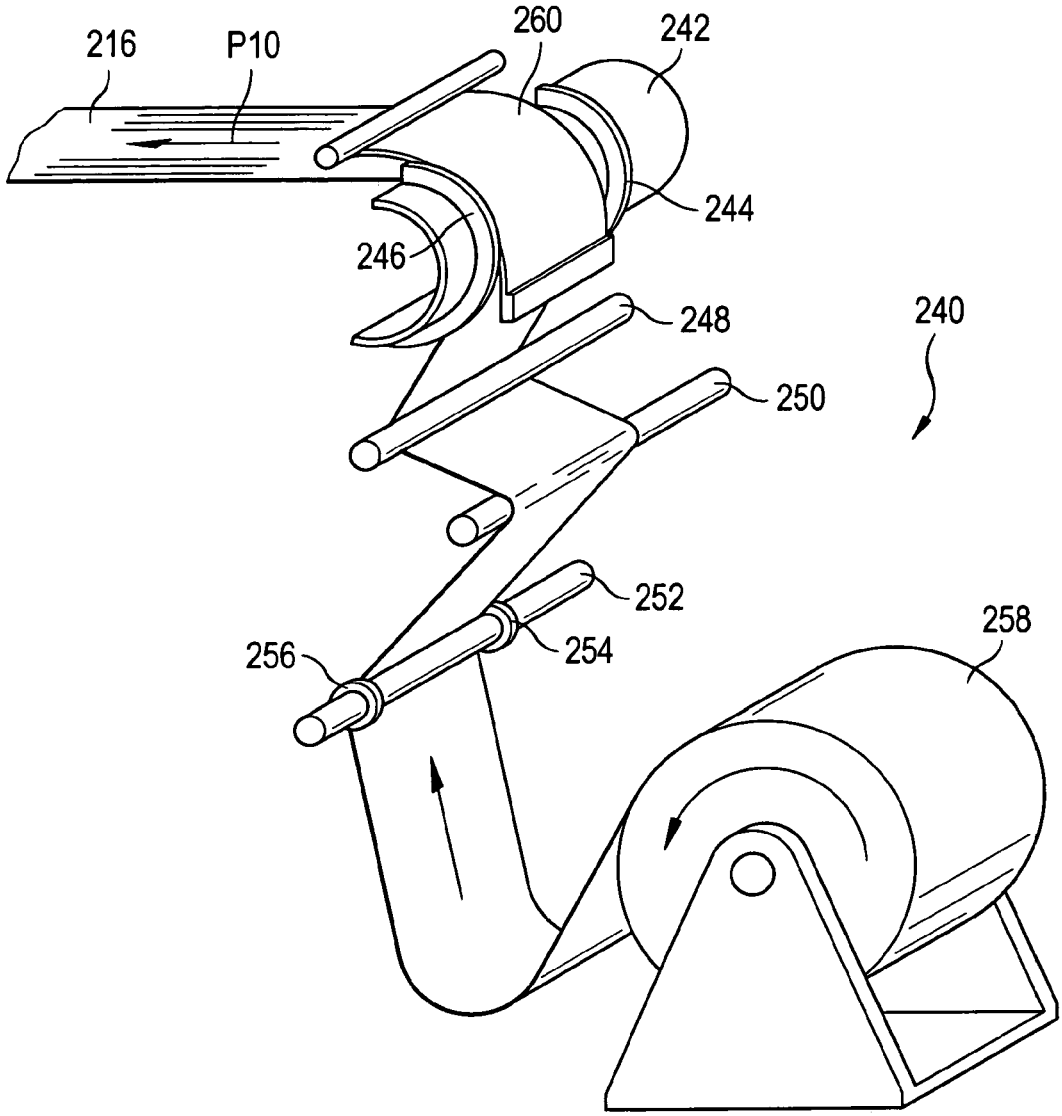
FIG. 19 is a perspective view which shows an example of a web guiding device.

FIG. 19 shows a web guiding device 240 which is provided upstream the driven roller 210 illustrated in the previous figures, as viewed in the direction P10 of the web transport. The web guiding device 240 serves on the one hand for pre-setting a position of the web edge of the web 216 and on the other hand for building up a predetermined web tension.

The web guiding device 240 includes a guiding sheet 242, for example a guiding plate, in the form of a partial cylinder surface area, on which the web 216 slides. The guiding sheet 242 has flanged wheel portions 244 and 246 on each side of the web edge, the flanged wheel portions guiding the web 216 on both sides. The flanged wheel portions 244 and 246 can be adjusted with respect to their distance from one another to the respective width of the web 216.

Guiding elements 248, 250 and 252, which can likewise carry flanged wheels, are provided upstream the guiding sheet 242, as for example illustrated for the guiding element 252 with the flanged wheels 254 and 256. These flanged wheels 254 and 256 have the effect that the web 216 that has been drawn-off from a roll 258 already has a predetermined lateral position in the feed region.

The guiding elements 248, 250 and 252 can be implemented as cylinders, over the respective surface area of which the web 216 is guided by respectively predetermined angles of contact. The respective angle of contact can be set by changing the position of the axes of the guiding elements 248, 250 and 252 with respect to one another. This is important when the same web tension is required for web materials with varying thicknesses.

In order to continue to set the web tension in a defined manner, a braking device is provided which acts on the guiding sheet 242. For example, this braking device can be implemented as a piece of felt 260 which presses on the web 216 sliding over the guiding sheet 242 with a variable weight. Further, devices can be employed as used for pre-centering and tensioning of the web 216 in the German patent application DE 44 01 906 of the same applicant. The German patent application DE 44 01 906 mentioned is herewith incorporated by reference into the disclosure of the present invention.

Figure 20:
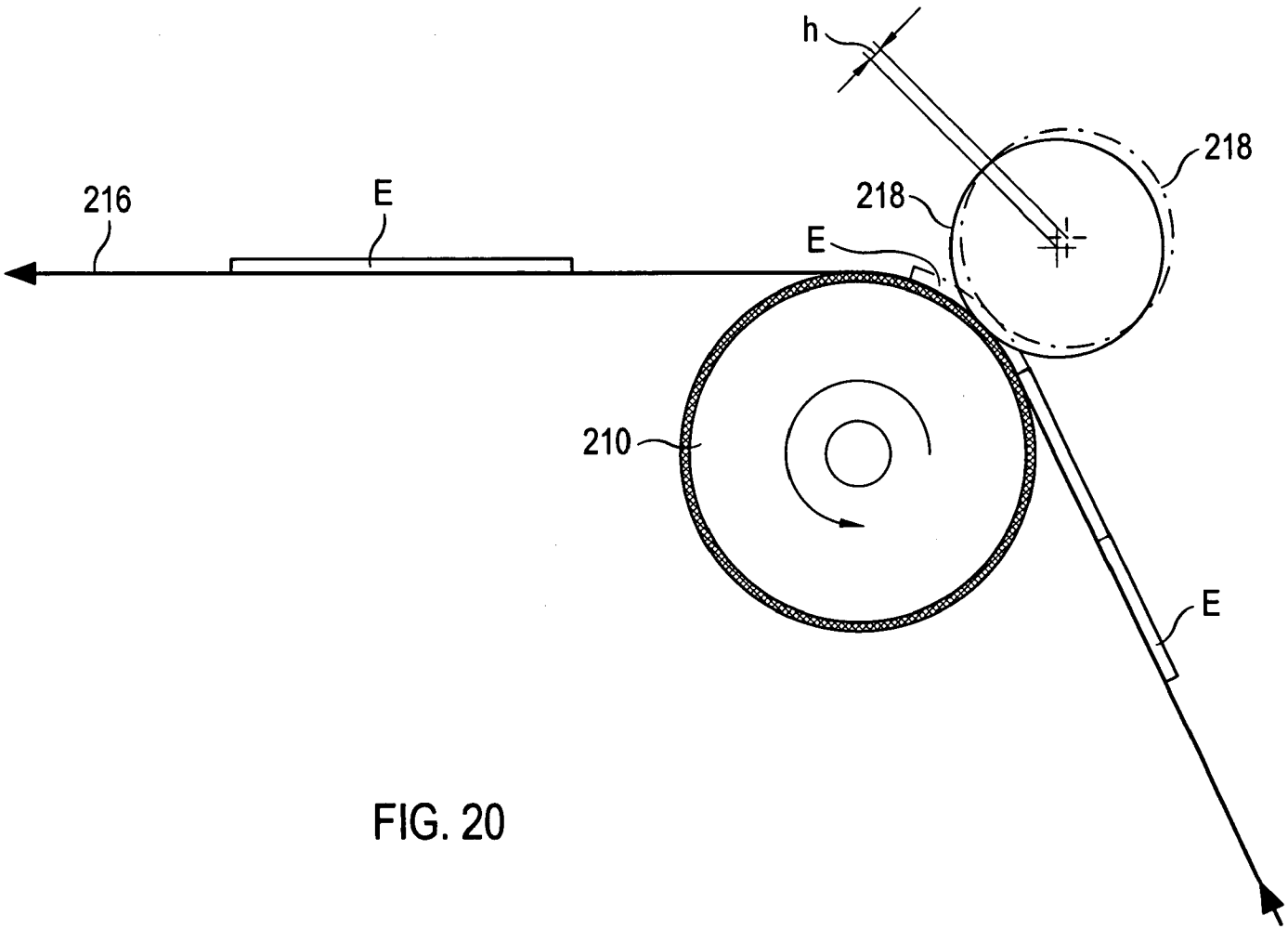
FIG. 20 is a schematic side view which shows an example of a web with adhesive labels applied thereto.

FIG. 20 shows a web 216 which is provided with adhesive labels E. In the case of such a web 216, that is used in practice, only the labels are to be printed in a printer or copier. The problem arises that when a label edge encounters the counter-pressure roller 218 the same is deflected by a lift distance h, as illustrated in FIG. 19 in broken lines. The lifting work that has to be performed by the counter-pressure roller 218 causes an abrupt change in torque together with a change in the load angle at the drive motor 220 (see FIG. 14). In operation, such an effect results in a disturbance in the print image in the printer, in particular when fine gray rasters are printed. The use of a soft coating for the counter-pressure roller 218, for example the use of foamed PUR (polyurethane) material, reduces this effect since the lift energy of the counter-pressure roller 218 is absorbed by the elasticity of the coating.

Figure 21:
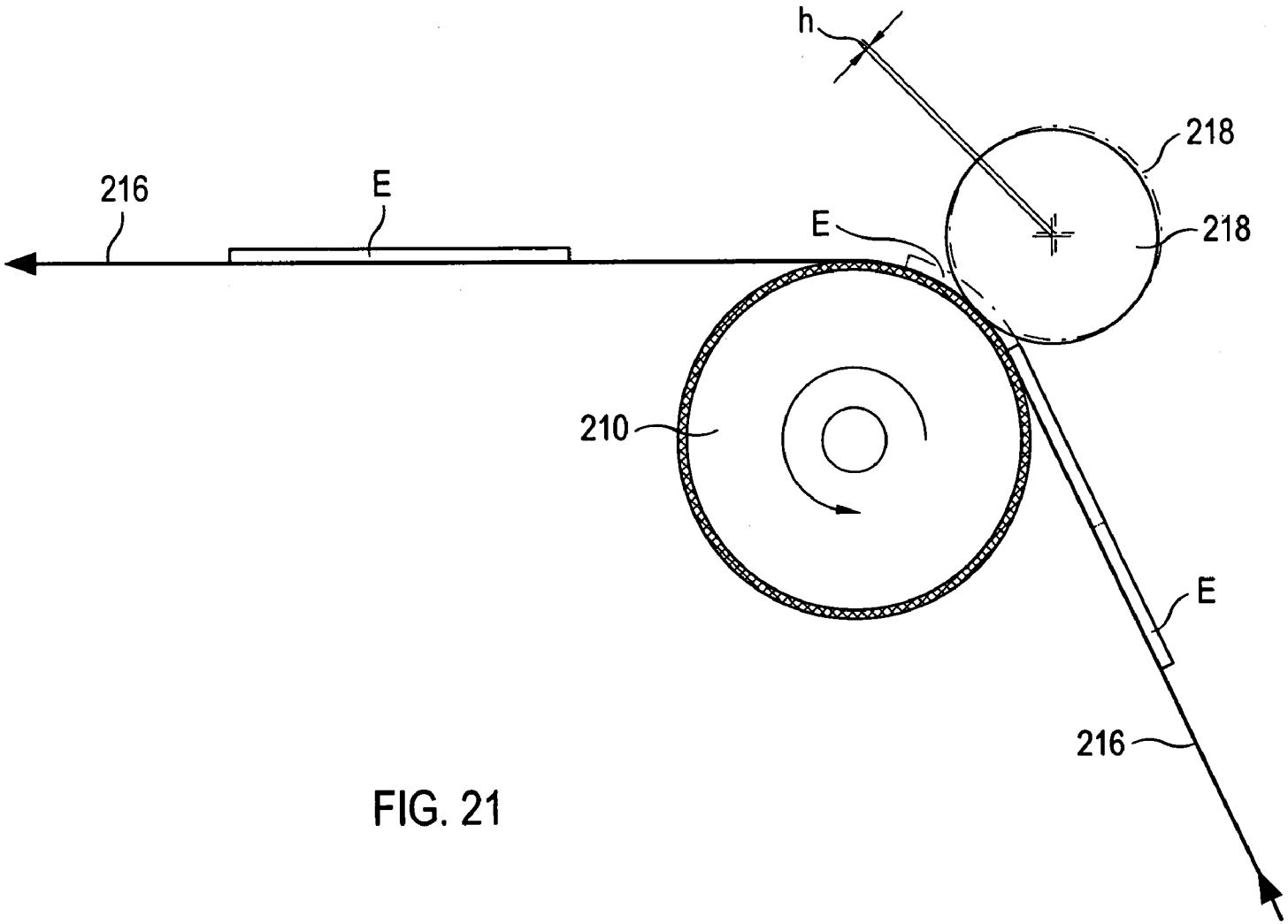
FIG. 21 is a schematic side view which shows the rolling behavior of the counter-pressure roller having a soft coating.

In FIG. 21 it is illustrated that the lift distance h is reduced when using a corresponding elastic coating.

Figure 22:
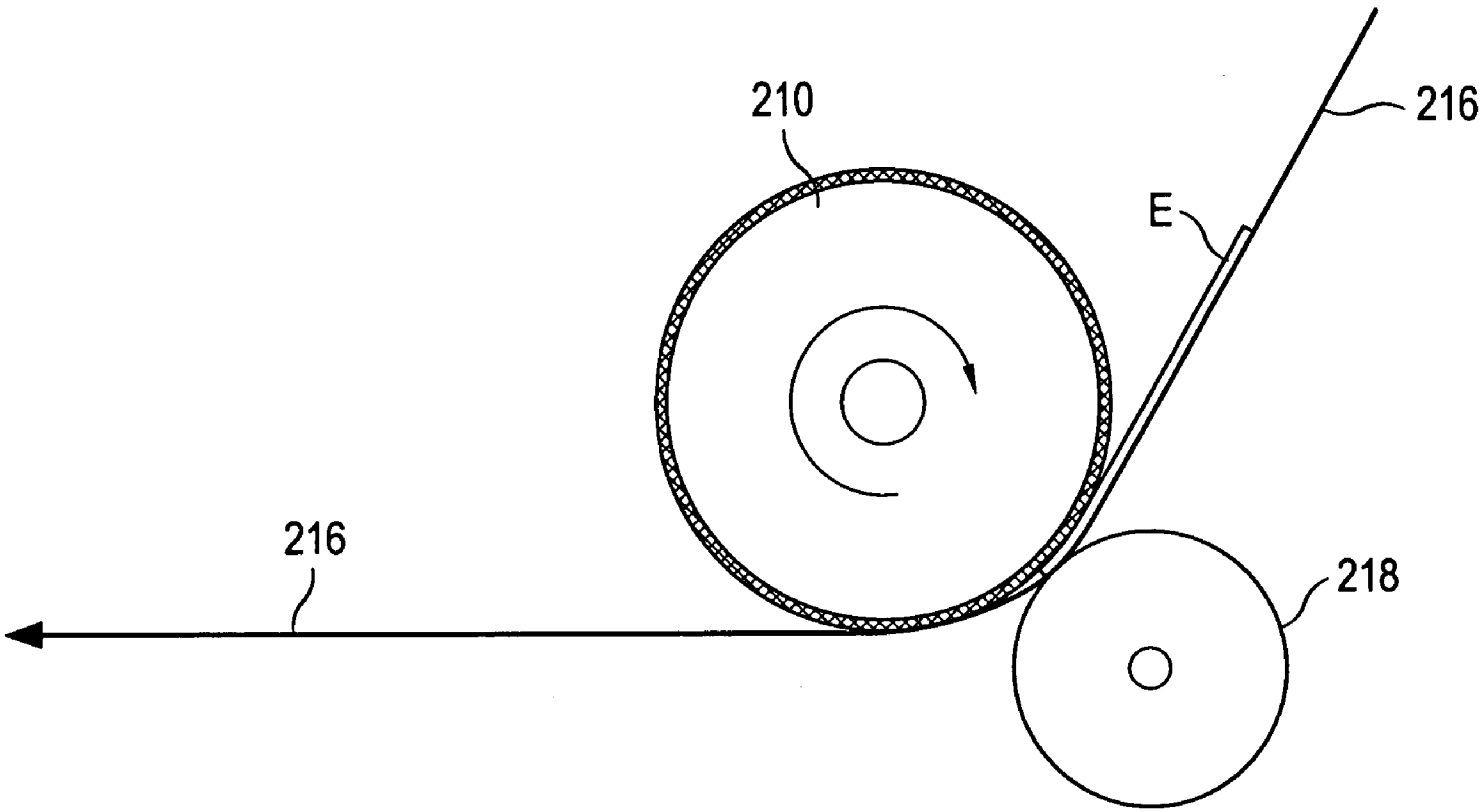
FIG. 22 is a schematic side view which shows a web with labels that are applied thereto on the side of the driven roller.

FIG. 22 shows an arrangement of the web 216, in which the labels are provided on the side facing the driven roller 210. Due to the wedge effect of the web 216 at the label edge a sort of start-up ramp is formed, as a result whereof the lifting work for the counter-pressure roller 218 does not have to be performed abruptly. The arrangement according to FIG. 22 can of course be combined with the one according to FIG. 21.

Figure 23:
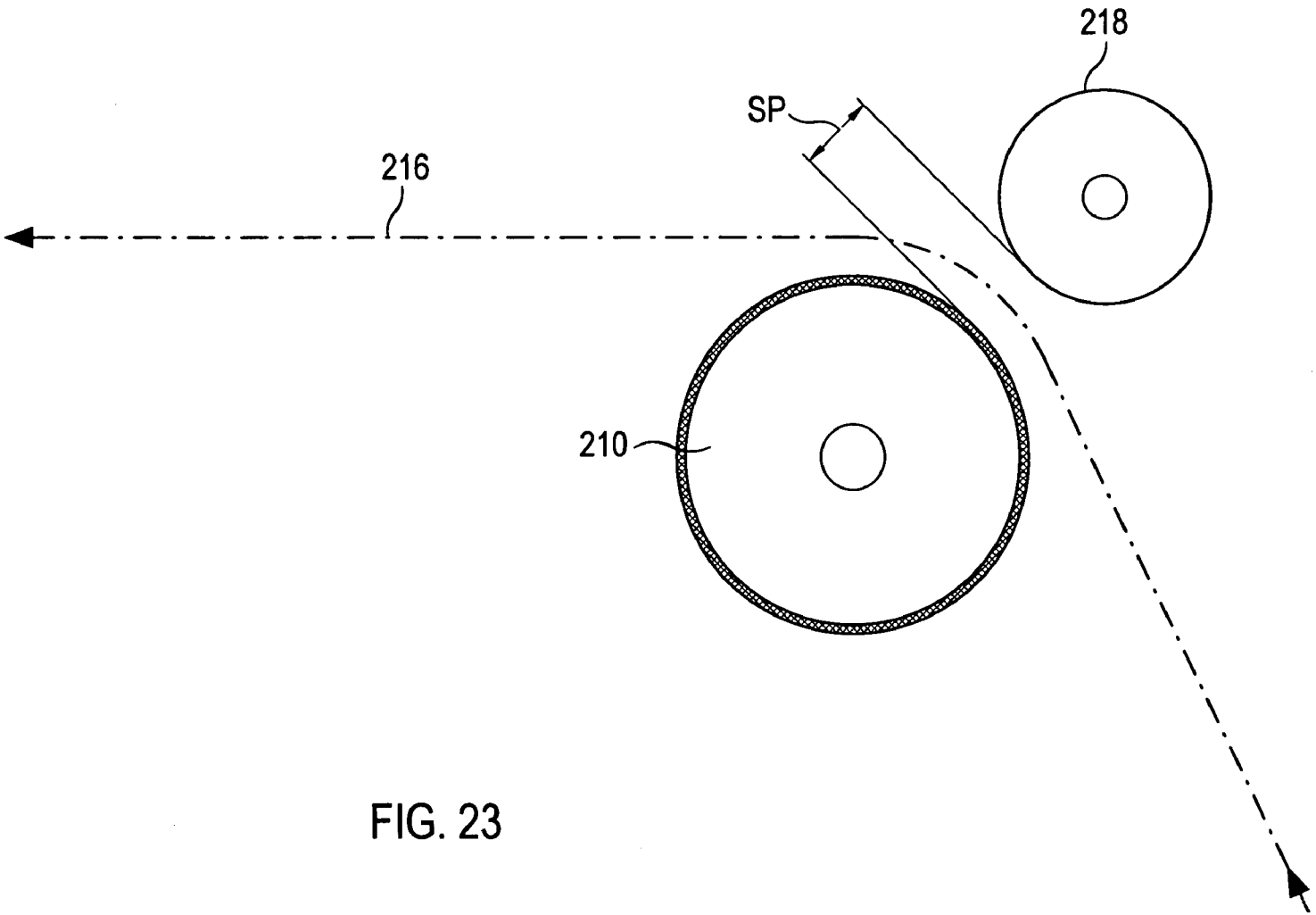
FIG. 23 is a schematic side view which shows an arrangement in which the counter-pressure roller device is swiveled away.

FIG. 23 illustrates that the counter-pressure rollers 218 can jointly be swiveled away from the driven roller 210, so that as a result a gap SP large enough for passing a web 216 is formed, the web being illustrated in broken lines. In this way, the insertion of a new web 216 can be facilitated.

Figure 24:
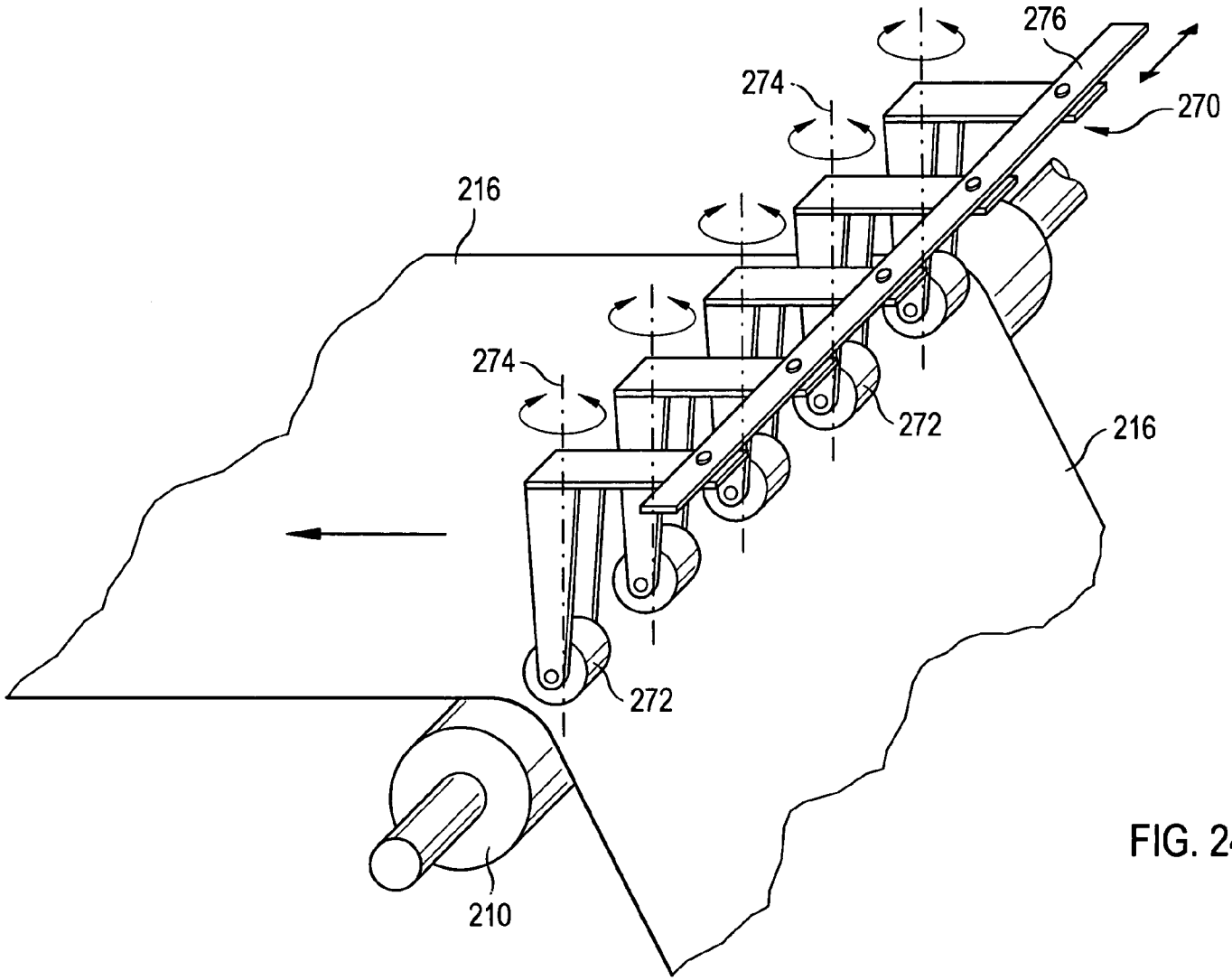
FIG. 24 is a perspective view that shows a web guiding device with a stationary driven roller and a plurality of pivotable counter-pressure rollers.

FIG. 24 shows a further example of the invention. The driven roller 210 is stationary, i.e. its axis does not change its position. The counter-pressure roller device 270 includes a plurality of rollers 272, which press the web 216 against the roller 210. The plurality of rollers 272 and the roller 210 are supported by a rotary frame. Each roller 272 can be pivoted about a rotational axis 274. The angle of rotation of the respective rotary roll 272 can be set by a rod 276, which acts on a lever end for each roll 272. Here, too, the web is urged during transport away in a tangential direction with respect to the surface of the respective roll 272, as a result whereof the position of the edge of the web 216 can be changed in the direction of the roller axis. The above described alternatives, for example with regard to the coatings for the driven roller 210 and the coatings for the rolls 272 can likewise be used here.

Various alternatives are possible. The rotary frame described in FIG. 14 can, for example, be a part of a closed loop control circuit. The actual position of the edge of the web 216 is detected with the aid of a sensor with respect to a desired position. Depending on the signal of the sensor, the frame is adjusted in its angle of rotation P12 stepwise or continuously such that a control deviation between the actual position and the desired position of the edge is reduced.

With regard to the embodiment according to FIG. 24, all counter-pressure rollers 272 are controlled simultaneously with the aid of the rod 276 and a drive. This drive can be part of a closed loop control circuit. With the aid of a sensor, the actual position of the edge with respect to a desired position is determined. Depending on the signal of the sensor, the angle of rotation is adjusted for each counter-pressure roller 272 such that a control deviation between an actual position and a desired position of the edge is reduced or becomes zero.

The illustrated examples of various aspects of the invention can advantageously be combined with one another, further alternatives arising therefrom. The rotary frame described in FIGS. 14 and 24 can be used in the example according to FIGS. 1 and 7. The control of the lateral edge of the web according to FIGS. 7 to 13 can be used in the examples according to FIGS. 1 to 7 and FIGS. 14 to 24.

Although in the drawings and in the previous description preferred embodiments have been illustrated and described in every detail, this is to be considered as being merely exemplary and as not restricting the invention. It is pointed out that only the preferred embodiments have been illustrated and described and all variations and modifications which are within the scope of the invention at present or in the future are to be protected.

Although other modifications and changes may be suggested by those skilled in the art, it is the intention of the inventors to embody within the patent warranted hereon all changes and modifications as reasonably and properly come within the scope of their contribution to the art.

We claim:

1. A device for controlling a position of a lateral edge of a continuous web of a recording medium in a printer or copier, comprising:

a web retracting device operable to exert a restraining force on the web;

an actuator mounted downstream of said web retracting device as viewed in a transport direction of the continuous web during normal printing operation, said actuator being operable to adjust a position of the lateral edge of the continuous web;

a web drive disposed downstream of said actuator which advances the continuous web in the transport direction against the restraining force of said retracting device;

at least one transfer printing station downstream of said web drive which prints toner images on the continuous web; and a take-off device downstream of said at least one transfer printing station which further conveys the continuous web for further processing;

a sensor in a region of said actuator which is operable to sense an actual position of the lateral edge of the continuous web and provide an actual signal;

a control device connected to compare the actual signal of said sensor with a desired signal corresponding to a desired position of the lateral edge of the continuous web and in case of a deviation to drive said actuator which changes a position of the lateral edge.

2. A device according to claim 1, wherein the desired position of the lateral edge is fixed at a location of said sensor.

3. A device according to claim 1, wherein said sensor determines measured values at predetermined distances along the continuous web, and wherein an average of said measured values is used by said control device as an actual signal for controlling the position of the lateral edge of the continuous web.

4. A device according to claim 3, wherein said average is one of a moving average and an exponential average.

5. A device according to claim 3, wherein said average is determined over a predetermined distance.

6. A device as claimed in claim 5, wherein said predetermined distance is a whole-numbered multiple of a standard format length of a print page.

7. A device according to claim 6, wherein said standard format length is a 12-inch format, and wherein said multiple is three.

8. A device according to claim 1, wherein said actuator includes a rotary frame mounted so that by rotation of said rotary frame the position of the lateral edge of the continuous web can be adjusted.

9. A device according to claim 8, wherein said sensor is provided in a region of said rotary frame in an outlet region for the continuous web.

10. A device according to claim 1, wherein said sensor is a first sensor and further comprising:

a second sensor in a region of said retracting device which senses an actual position of the lateral edge of the continuous web in said region to provide an actual second signal, and wherein said actual second signal is taken into account when controlling the lateral edge to a desired position in the region of said first sensor.

11. A device according to claim 10, further comprising:

a delay connected to receive said actual second signal of said second sensor to produce a delayed second actual signal that is delayed by a time which is required by the continuous web during transport from a location of said second sensor to a location of said first sensor.

12. A device according to claim 11, wherein said delayed actual signal of said second sensor is superimposed on a desired signal.

13. A device according to claim 9, wherein said retracting device includes a web brake; and further comprising:

a second sensor provided shortly downstream said web brake as viewed in the transport direction.

14. A device according to claim 9, further comprising:

a web supply provided in a web feed region as viewed in the transport direction, said web supply including a lateral stop along which the lateral edge of the web is guided.

15. A device according to claim 1, further comprising:

a further sensor in a region of said at least one transfer printing station, said further sensor sensing an actual position of the lateral edge of the continuous web to produce an actual signal, and said actual signal of said further sensor being supplied to said control device when driving said actuator.

16. A device according to claim 15, wherein an actual value/desired value comparison is carried out between the actual signal of said further sensor and a desired signal, the desired signal being fixed corresponding to a desired position of the lateral edge with respect to a position of said further sensor, and a result of the comparison being fed to said control device.

17. A device according to claim 16, wherein a desired value/actual value comparison for the position of the lateral edge at a location of said further sensor takes place in said control device and a first control deviation is determined, and further a desired value/actual value comparison is carried out with respect to a location of said first sensor, the afore-mentioned control deviation being taken into account as the desired value.

18. A device according to claim 15, wherein said further sensor is provided within a region of±100 mm relative to a transfer printing location of said at least one the transfer printing station.

19. A device according to claim 1, wherein said sensor is a line sensor in a form of a CCD sensor.

20. A method for controlling a position of a lateral edge of a continuous web of a recording medium in a printer or copier, comprising the steps of:

exerting a restraining force on the continuous web by a web retracting device;

adjusting a position of the lateral edge of the web downstream of said web retracting device as viewed in a transport direction of the continuous web during a normal printing operation by an actuator;

advancing the continuous web by a web drive downstream of said actuator in the transport direction against the restraining force of said retracting device;

printing toner images on the continuous web downstream of said web drive by at least one transfer printing station;

further conveying the continuous web by a take-off device downstream of said at least one transfer printing station;

sensing an actual position of the lateral edge of the web by a sensor in a region of said actuator and therefrom producing an actual signal;

comparing the actual signal of said sensor with a desired signal corresponding to a desired position of the lateral edge of the continuous web by a control device; and in case of a deviation driving said actuator which changes a position of the lateral edge.

21. A method according to claim 20, wherein the desired position of the lateral edge is fixed at a location of said sensor.

22. A method according to claim 20, wherein said sensor determines measured values at predetermined distances along the continuous web, and further comprising the step of:

using an average of measured values as an actual signal for controlling the position of the lateral edge of the web.

23. A method according to claim 22, wherein one of a moving average and an exponential average is used as said average.

24. A method according to claim 22, wherein said average is determined over a predetermined distance.

25. A method as claimed in claim 24, wherein said average corresponds to a whole-numbered multiple of a standard format length of a print page.

26. A method according to claim 25, wherein a 12-inch format is used as the standard format length, and wherein the multiple is three.

27. A method according to claim 20, wherein said actuator includes a rotary frame, and further comprising the step of:

rotating said rotary frame to adjust a position of the lateral edge of the continuous web.

28. A method according to claim 27, wherein said sensor is provided in a region of said rotary frame in an outlet region for the continuous web.

29. A method according to claim 20, wherein said sensor is a first sensor and further comprising the steps of:

sensing an actual position of the lateral edge of the continuous web in a region of said retracting device by a second sensor to produce a second actual signal, and taking said second actual signal into account when controlling the lateral edge to a desired position in a region of said first sensor.

30. A method according to claim 29, further comprising the step of:

delaying said second actual signal of said second sensor by a time which is required by the continuous web during transport from a location of said second sensor to a location of said first sensor.

31. A method according to claim 30, wherein said delaying step produces a delayed actual signal, and further comprising the step of:

superimposing said delayed actual signal of the second sensor on a desired signal.

32. A method according to claim 29, wherein said retracting device includes a web brake, and wherein said second sensor is provided downstream said web brake as viewed in a transport direction.

33. A method according to claim 29, further comprising the step of:

providing a web supply in a web feed region, said web supply including a lateral stop along which the lateral edge of the web is guided.

34. A method according to claim 20, further comprising the steps of:

sensing an actual position of the lateral edge of the continuous web by a further sensor in a region of the transfer printing station to produce a further actual signal, and taking said further actual signal of said further sensor into account by said control device when driving said actuator.

35. A method according to claim 34, further comprising the steps of:

comparing an actual value/desired value between said further actual signal of said further sensor and a desired signal, said desired signal being fixed corresponding to a desired position of the lateral edge with respect to a position of said further sensor; and feeding a result of the comparing step to said control device.

36. A method according to claim 35, wherein said comparing of the desired value/actual value for a position of the lateral edge at a location of said further sensor takes place in said control device and a first control deviation is determined, and carrying out a further desired value/actual value comparison out with respect to the location of said first sensor, said control deviation being taken into account as the desired value.

37. A method according to claim 34, wherein said further sensor is provided within a region of±100 mm relative to a transfer printing location of said at least one transfer printing station.

38. A method according to claim 20, wherein said sensor is a line sensor in a form of a CCD sensor.

* * * * *